US008493203B2

(12) United States Patent
Egawa et al.

(10) Patent No.: US 8,493,203 B2
(45) Date of Patent: Jul. 23, 2013

(54) ALARM DEVICE

(75) Inventors: Yoshitaka Egawa, Tokyo (JP); Hidenari Matsukuma, Yamato (JP)

(73) Assignee: Hochiki Corporation, Tokyo (JP)

( * ) Notice: Subject to any disclaimer, the term of this patent is extended or adjusted under 35 U.S.C. 154(b) by 270 days.

(21) Appl. No.: 12/933,698

(22) PCT Filed: Mar. 13, 2009

(86) PCT No.: PCT/JP2009/054848
§ 371 (c)(1),
(2), (4) Date: Sep. 21, 2010

(87) PCT Pub. No.: WO2009/119340
PCT Pub. Date: Oct. 1, 2009

(65) Prior Publication Data

US 2011/0025490 A1 Feb. 3, 2011

(30) Foreign Application Priority Data

Mar. 24, 2008 (JP) ..... 2008-075037
Mar. 24, 2008 (JP) ..... 2008-075119

(51) Int. Cl.
*G08B 29/00* (2006.01)

(52) U.S. Cl.
USPC ..... 340/514; 340/501; 340/516; 714/741

(58) Field of Classification Search
None
See application file for complete search history.

(56) References Cited

U.S. PATENT DOCUMENTS 3,510,863 A * 5/1970 McBrian ..... 340/529
5,889,468 A 3/1999 Banga
6,028,513 A 2/2000 Addy (Continued)

FOREIGN PATENT DOCUMENTS

CN 1192086 A 9/1998
EP 1501060 A1 1/2005

(Continued)

OTHER PUBLICATIONS

Japanese Patent Office, Search Report and Written Opinion in International Patent Application No. PCT/JP2009/054848 dated Apr. 28, 2009.

(Continued)

*Primary Examiner* — Travis Hunnings
(74) *Attorney, Agent, or Firm* — Wood, Herron & Evans, LLP

(57) ABSTRACT

An alarm device includes: a wireless circuit section which wirelessly exchanges event signals with an other alarm device; an alert section which outputs an alarm; an operation section which accepts predetermined operations; a sensor section which issues an abnormal condition detection signal when an abnormal condition occurred is detected within a monitoring area; an abnormal condition monitoring section which, upon receiving the abnormal condition detection signal from the sensor section, outputs an abnormal condition alarm as a linkage source from the alert section, and transmits an event signal indicating an abnormal condition to the other alarm devices, and conversely, upon receiving an event signal indicating an abnormal condition from the other alarm device, outputs an abnormal condition alarm as a linkage destination from the alert section; a communication test transmission processing section which, at a predetermined timing, transmits an event signal indicating a communication test to the other alarm device and; a communication test reception processing section which, upon receiving an event signal indicating a communication test from the other alarm device, announces the reception status of this event signal.

13 Claims, 24 Drawing Sheets

U.S. PATENT DOCUMENTS

| | | | | |
|---|---|---|---|---|
| 6,078,269 | A | 6/2000 | Markwell et al. | |
| 6,150,936 | A | 11/2000 | Addy | |
| 2001/0038336 | A1 | 11/2001 | Acevedo | |
| 2005/0010769 | A1 * | 1/2005 | You et al. | 713/168 |
| 2006/0082453 | A1 | 4/2006 | Kaiser | |
| 2007/0063837 | A1 | 3/2007 | McKenna et al. | |

FOREIGN PATENT DOCUMENTS

| | | |
|---|---|---|
| JP | 62-168299 | 7/1987 |
| JP | 04-076697 | 3/1992 |
| JP | 5-79694 | 10/1993 |
| JP | 07-182574 | 7/1995 |
| JP | 09-035159 | 2/1997 |
| JP | 09-115074 | 5/1997 |
| JP | 09-212777 | 8/1997 |
| JP | 2000-137889 | 5/2000 |
| JP | 2002-074535 | 3/2002 |
| JP | 2005-038401 | 2/2005 |
| JP | 2005-044318 | 2/2005 |
| JP | 2005-222319 | 8/2005 |
| JP | 2006-011791 | 1/2006 |
| JP | 2006-067020 | 3/2006 |
| JP | 2006-178723 | 7/2006 |
| JP | 2006-339762 | 12/2006 |
| JP | 2006-350412 | 12/2006 |
| JP | 2007-094719 | 4/2007 |
| JP | 2007-200004 | 8/2007 |
| JP | 2007-318566 | 12/2007 |
| JP | 2008-033410 | 2/2008 |
| JP | 2008-33428 | 2/2008 |
| JP | 2008-108074 | 5/2008 |
| WO | 0043968 A1 | 7/2000 |
| WO | 2006085781 A1 | 8/2006 |

OTHER PUBLICATIONS

International Search Report issued in International Patent Application No. PCT/JP2008/071339; Feb. 24, 2009; 6 pages; Japanese Patent Office.

Office Action issued in U.S. Appl. No. 12/991,318; Jan. 10, 2013; 5 pages; U.S. Patent and Trademark Office.

Office Action issued in Japanese Patent Application No. 2012-018949; Feb. 19, 2013; 6 pages; Japanese Patent Office.

Office Action issued in Japanese Patent Application No. 2012-018948; Mar. 12, 2013; 8 pages; Japanese Patent Office.

Office Action issued in Chinese Patent Application No. 200880129022.0; Jan. 31, 2013; 18 pages; State Intellectual Property Office of the People's Republic of China.

Supplementary European Search Report and Written Opinion issued in European Application No. EP 09724915.5, mailed May 6, 2013 (17 pages).

Supplementary European Search Report and Written Opinion issued in European Application No. EP 08874206.9, mailed May 7, 2013 (8 pages).

* cited by examiner

ALARM DEVICE

BACKGROUND OF THE INVENTION

1. Field of the Invention

The present invention relates to an alarm device which detects an abnormal condition such as a fire and emits an alarm, and also wirelessly transmits a signal to other alarm devices to facilitate linked alarm output.

Priority is claimed on Japanese Patent Application No. 2008-075037, and Japanese Patent Application No. 2008-075119, the contents of which are incorporated herein by reference.

2. Description of Related Art

Conventionally, household alarm devices (hereafter "alarm devices") which detect abnormal conditions such as fires or gas leaks in a residence and issue an alarm have become prevalent, and in recent years there is a proposal for ones that monitor for abnormal conditions such as a fire on a room-by-room basis by installing a plurality of alarm devices throughout a single residence (refer to Japanese Unexamined Patent Application, First Publication No. 2007-094719, for example).

When a plurality of alarm devices are installed in a single residence in this manner, a person who is present in a different room from the room where the abnormal condition occurred may not hear the alarm sound, giving the fire or other problem a chance to spread. Therefore, by connecting the alarm devices to the others using wires, when a particular alarm device detects a fire and issues an alarm, the signal is sent to the other alarm devices so that the alarm is emitted simultaneously, thereby realizing a linked alarm system.

However, because providing a wired connection between alarms requires that wiring be installed, a problem arises in terms of increased costs. This problem can be resolved by employing wireless alarm devices. Furthermore, accompanying the recent reduction in power consumption of the ICs used in modern wireless circuits, even when operating in a state of constant readiness to receive alarm signals from other alarm devices, battery life that is sufficient from a practical standpoint, for example five years or longer, is assured, and the practical use of wireless alarm devices is thus advancing.

However, with wireless alarm devices which enable linked alarms output, a problem exists whereby the surrounding environment has an effect on communication range, preventing a stable communication environment from being secured on an ongoing basis. For example if wireless alarm devices are installed in each room in a residence, communication may be impeded when the door to a room is closed. When the communication environment is adversely affected in this way, a problem may occur in that when a given alarm device detects a fire or other abnormal condition and issues an alarm, an alarm cannot be output from the other alarm devices serving as linkage destinations.

A first object of the present invention is to provide an alarm device capable of performing reliable linked alarm output wirelessly between a plurality of alarm devices.

On the other hand, with a conventional wired alarm device, when a plurality of alarm devices are wired together, and a given alarm device detects a fire, the linkage source alarm device which detected the fire and the linkage destination alarm devices output different alarm sounds. For example a siren followed by a voice message "The fire alarm has activated. Please verify." may be output continuously in the linkage source alarm device which detected the fire, and on the other hand the linkage destination alarm devices may continuously output a siren followed by a voice message "The fire alarm in another room has activated. Please verify."

On the other hand, in the alarm device, an alarm stop switch which also functions as a test switch is provided, and the alarm can be stopped when the switch is operated during alarm output by a pull cord or other means. In the case of alarm devices linked by wiring, when the alarm stop switch of the linkage source alarm device which detects the fire is operated, the audible alarm of all alarm devices stops. Furthermore, when the alarm stop switch of a linkage destination alarm device is operated, only the audible alarm of that alarm device stops.

Incidentally, in this type of alarm device, a function is provided for detecting and reporting failures such as a low battery revealed by a drop in battery voltage. A low battery is detected when the battery voltage has dropped to the minimum voltage required for the alarm device to operate not ally for a span of 72 hours, whereupon an audible alarm in the form of a short beep at one minute intervals is output, for example.

However, when an alarm device is installed in an unoccupied room, even if a low battery is detected and an audible alarm is output, there is a danger of the battery going flat if the alarm goes unnoticed by a user.

A second object of the present invention is to provide an alarm device which, when a failure occurs among a plurality of alarm devices which perform linked alarm output, reliably informs users of such and enables the appropriate response to be taken.

SUMMARY OF THE INVENTION

To achieve the first object described above, the present invention employs the following measures:

(1) An alarm device according to a first aspect of the present invention comprises: a wireless circuit section which wirelessly exchanges event signals with an other alarm device; an alert section which outputs an alarm; an operation section which accepts a predetermined operation; a sensor section which issues an abnormal condition detection signal when an abnormal condition occurred is detected within a monitoring area; an abnormal condition monitoring section which, upon receiving the abnormal condition detection signal from the sensor section, outputs an abnormal condition alarm as a linkage source from the alert section, and transmits an event signal indicating the abnormal condition to the other alarm device, and conversely, upon receiving an event signal indicating an abnormal condition from the other alarm device, outputs an abnormal condition alarm as a linkage destination from the alert section; a communication test transmission processing section which, at a predetermined timing, transmits an event signal indicating a communication test to the other alarm device and; a communication test reception processing section which, upon receiving an event signal indicating a communication test from the other alarm device, announces the reception status of this event signal.

(2) In the alarm device disclosed in (1) above, the construction may be such that the communication test transmission processing section transmits an event signal indicating the transmission test to the other alarm device either when the operation section is operated, when a predetermined time has elapsed since the operation section is operated, or when an event signal indicating the transmission test is received from the other alarm device.

(3) In the alarm device disclosed in (1) above, the construction may be may be such that the communication test reception processing section, upon receiving an event signal indicating the communication test from the other alarm device, measures the signal strength, and if the measured signal strength exceeds a predetermined threshold strength, judges a normal test, and issues an announcement.

(4) In the alarm device disclosed in (3) above, the threshold strength may be a value obtained by adding a predetermined value to the reception sensitivity of the wireless circuit section.

(5) In the alarm device disclosed in (3) above, the construction may be may be such that the communication test reception processing section, upon judging a normal test, issues an announcement corresponding to the measured signal strength.

(6) In the alarm device disclosed in (1) above, the construction may be may be such that which the communication test transmission processing section, when no communication test has been performed for longer than a fixed period, issues an announcement urging that a communication test be performed.

(7) In the alarm device disclosed in (1) above, the construction may be may be such that when the communication test reception processing section judges an abnormal test, at least the behavior and processing performed in the role of a linkage destination is stopped, permitting operation as a dedicated linkage source alarm device or a standalone alarm device.

In addition, to achieve the second object described above, the present invention employs the following measures:

(8) An alarm device according to a second aspect of the present invention comprises: a transmission and reception section which exchanges event signals with an other alarm device; a sensor section which detects an abnormal condition and issues an abnormal condition detection signal; an alert section which outputs an abnormal condition alarm; an operation section having an alarm stopping device; an abnormal condition monitoring section, provided integrally or separately, which upon receiving the abnormal condition detection signal from the sensor section, outputs the abnormal condition alarm as a linkage source from the alert section and transmits an event signal indicating an abnormal condition to the other alarm device, and conversely, upon receiving an event signal indicating an abnormal condition from the other alarm device, outputs an abnormal condition alarm as a linkage destination from the alert section and; a failure monitoring section which, when a failure is detected in the sensor section, outputs a failure alarm and transmits an event signal indicating the failure to the other alarm device, and conversely, upon receiving an event signal indicating a failure from the other alarm device, outputs a failure alarm in a linked manner.

(9) The alarm device disclosed in (8) above may further comprise a failure source confirmation processing section which, if operation of the alarm stop device is detected during linked output of the failure alarm, transmits an event signal for failure source confirmation to the other alarm device, and conversely, when an event signal for failure source confirmation is received from the other alarm device when the alarm device itself is the failure source, outputs an abnormal condition alarm indicating the failure source.

(10) In the alarm device disclosed in (8) above, the construction may be may be such that the failure monitoring section, upon receiving an event signal indicating a failure from the other alarm device, after a predetermined time has elapsed which differs from that of the other alarm device, outputs an audible failure alarm in a linked manner.

(11) An alarm device according to a third aspect of the present invention comprises: a transmission and reception circuit section which exchanges event signals with an other alarm device; a sensor section which detects an abnormal condition; an alert section which outputs an abnormal condition alarm; an operation section having an alarm stop device; an abnormal condition monitoring section which, upon detecting an abnormal condition in the sensor section, outputs the abnormal condition alarm as a linkage source from the alert section and transmits an event signal indicating an abnormal condition to the other alarm device, and conversely, upon receiving an event signal indicating an abnormal condition from the other alarm device, outputs the abnormal condition alarm as a linkage destination from the alert section and; a failure monitoring section in which a representative setting for failure announcement is present or absent, which upon detecting a failure, outputs a failure alarm if the representative setting is present, and transmits an event signal indicating the failure to the other alarm device if the representative setting is absent, and conversely, upon receiving an event signal indicating a failure from the other alarm device, outputs a representative failure alarm if the representative setting is present.

(12) In the alarm device disclosed in (11) above, the construction may be may be such that the abnormal condition monitoring section, upon detecting a failure, outputs the failure alarm even if the representative setting is absent.

(13) The alarm device disclosed in (11) above may further comprise a failure source confirmation processing section which, if operation of the alarm stop device is detected while the failure alarm is being output based on an event signal indicating a failure received from the other alarm device, switches to outputting an alarm indicating a failure source if the local alarm device is the failure source, and if the local alarm device is not the failure source, stops the failure alarm and transmits an event signal for failure source confirmation to the other alarm device, and conversely, upon receiving an event signal for failure source confirmation from the other alarm device, outputs an alarm indicating a failure source if the local alarm device is the failure source.

In the alarm device according to the first aspect disclosed in (1) above, an event signal for a communication test is transmitted to the other alarm devices when an alarm device test switch or the like is operated, and in response, the other alarm devices announce their reception status. By these announcements, users can ascertain the status of wireless communication between a plurality of alarm devices. If an abnormal condition is judged due to poor test results for reception status, measures can be taken such as changing the installed locations of alarm devices. As a result, when an abnormal condition such as a fire occurs, linked alarm output can be performed wirelessly by a plurality of alarm devices in a reliable manner, thereby enhancing the reliability of linked alarm output. Accordingly, the first object whereby reliable linked alarm output can be performed wirelessly between a plurality of residential alarm devices can be realized.

Furthermore, by employing a configuration in which a graphic or voice message reflecting the received signal strength is displayed or output even if the test results are judged as normal, a measure of the communication status can be easily ascertained. In this case, when the test results are only borderline normal, proactive measures can be taken such as changing the installed location of the alarm devices to achieve more reliable alarm linkage, enabling the reliability of alarm linkage to be further enhanced.

Moreover, in the alarm device according to the second aspect disclosed in (8) above, when a failure such as a low battery occurs in any of a plurality of wireless alarm devices installed in a linked manner in a residence or the like, this failure is reported to the other alarm devices and an audible failure alarm is output in a linked manner. Accordingly, when a failure occurs in an alarm device installed in an unoccupied room, the fact that a failure has occurred in an alarm device can be ascertained from the failure alarm emitted by the other alarm devices. As a result, a situation in which a failure goes unnoticed causing an alarm device to fail to operate in the event of an actual fire can be prevented. Therefore, the second object whereby a failure occurring among a plurality of alarm devices which perform linked alarm output can be reliably ascertained permitting the appropriate action to be taken, can be realized.

Furthermore, in the alarm device disclosed in (9) above, when an audible failure alarm is output by all alarm devices including the failure source, if an alarm stop operation is performed at an arbitrary alarm device, an event signal to confirm the failure source is transmitted to the other alarm devices. Thereupon, the audible failure alarm of the failure source alarm device changes to an audible announcement indicating a failure source. As a result, the alarm device where the failure occurred can be identified by straightforward and simple means, and measures such as repair can be taken.

Moreover, in the alarm device according to (10) above, when an audible failure alarm is to be output by all alarm devices including the failure source, by outputting the audible failure alarms in a preset sequence, any ambiguity that results when a plurality of alarm devices report a failure concurrently can be avoided.

Furthermore, in the alarm device according to the third aspect disclosed in (11) above, by designating an alarm device installed in a well trafficked area such as a living room a failure representative alarm in advance, when a failure occurs in any of the plurality of alarm devices, an audible failure alarm is output from the specific alarm device designated the failure representative, enabling failure monitoring to be performed in a centralized manner via a specific alarm device.

Moreover, in the alarm device disclosed in (12) above, when an audible failure alarm is output by the failure representative alarm device, if an alarm stop operation is performed, an event signal for failure source confirmation is transmitted to the other alarm devices, and an audible announcement indicating the failure source is output from the failure source alarm device, enabling the alarm device where the failure occurred to be identified by straightforward and simple means, and allowing measures such as repair to be taken.

BRIEF DESCRIPTION OF THE REFERENCE SYMBOLS

Figure 1A:
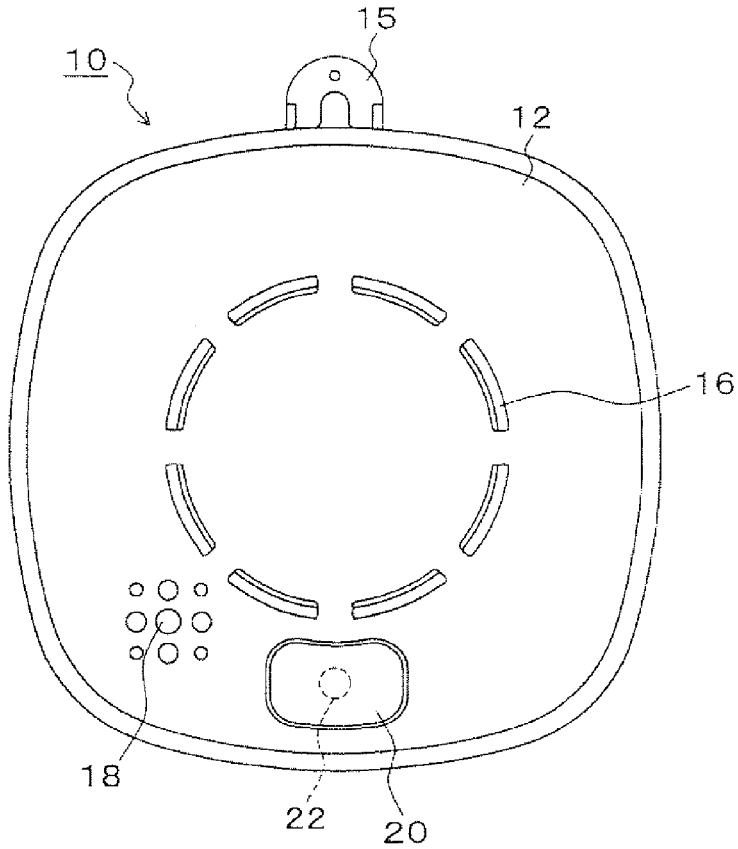
FIG. 1A is a front view of the outward appearance of an alarm device according to a first embodiment of the present invention.

10, 10-1 to 10-5 Alarm device
12 Cover
14 Main unit
15 Mounting hook
16 Smoke detector section
18 Sound hole
20 Alarm stop switch
22 LED
24 Residence
26 Garage
28 CPU
30 Wireless circuit section
31 Antenna
32 Storage circuit section
34 Sensor section
36 Alert section
38 Operation section
40 Battery power supply
42 Transmission circuit
44 Reception circuit
45 Signal strength measurement section
46 Memory
48 Event signal
50 Transmission source code
52 Group code
54 Event code

56 Speaker
58 Abnormal condition monitoring section
60 Communication test transmission processing section
62 Communication test reception processing section
64 Signal strength display section
110, 110-1 to 110-5 Alarm device
112 Cover
114 Main unit
115 Mounting hook
116 Smoke detector section
118 Sound hole
120 Alarm stop switch
122 LED
124 Residence
126 Garage
128 CPU
130 Wireless circuit section
131 Antenna
132 Storage circuit section
134 Sensor section
136 Alert section
138 Operation section
140 Battery power supply
142 Transmission circuit
144 Reception circuit
146 Memory
148 Event signal
150 Transmission source code
152 Group code
154 Event code
156 Speaker
158 Abnormal condition monitoring section
160 Failure monitoring section
162 Failure source confirmation processing section
164 Sequence setting section
166 Failure representative setting section

DETAILED DESCRIPTION OF THE INVENTION

First Embodiment

Figure 1B:
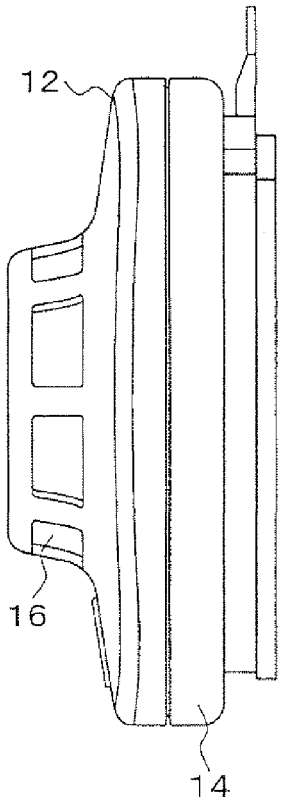
FIG. 1B is a side view of the outward appearance of the same alarm device.

FIG. 1A and FIG. 1B are explanatory drawings showing the outward appearance of a wireless alarm device according to a first embodiment of the present invention, wherein FIG. 1A is a front view and FIG. 1B a side view.

As shown in FIG. 1A and FIG. 1B, an alarm device 10 of the present embodiment comprises a cover 12 and a main unit 14. At the center of the cover 12, a smoke detector section 16, with openings through which smoke can enter formed around the periphery, is disposed, which detects a fire when smoke from the fire reaches a predetermined concentration.

At the lower left side of the smoke detector section 16, a sound hole 18 is provided. A speaker (not shown in the drawing) is housed behind this such that an audible alarm or voice message can be output. Underneath the smoke detector section 16, an alarm stop switch 20 is provided. The alarm stop switch 20 also functions as a test switch.

Inside the alarm stop switch 20, an LED 22 is installed as illustrated by the dashed line. When the LED 22 is lit, the lit status of the LED 22 can be visually recognized from outside through the switch cover of the alarm stop switch 20.

A mounting hook 15 is provided at the top of the back side of the main unit 14, and by screwing a screw or the like into a wall of the room where the alarm device 10 is to be installed, and fitting the mounting hook 15 over this screw, the alarm device 10 can be mounted to the wall surface.

In the alarm device 10 of FIG. 1, an example of an alarm device which comprises a smoke detector section 16 and detects the smoke produced by fire is used, but the present invention is not limited thereto. In other words, alternatively, an alarm device comprising a thermistor which detects the heat produced by a fire, or an alarm device which detects not fire but gas leaks are also included in the scope of the present invention.

Figure 2:
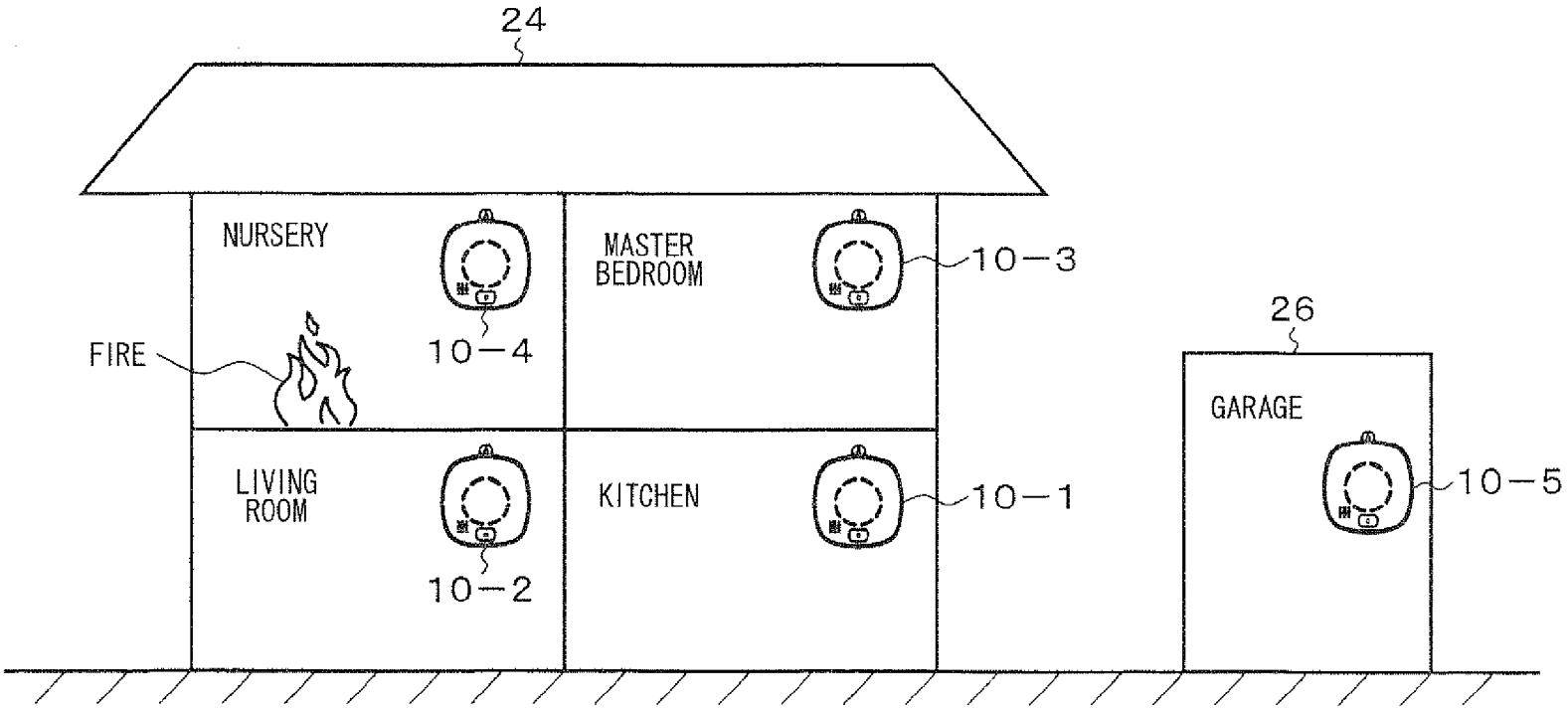
FIG. 2 is an explanatory drawing showing a situation where alarm devices are installed in a residence.

FIG. 2 is an explanatory drawing showing a situation in which alarm devices of the present embodiment are installed in a residence. In the example in FIG. 2, alarm devices 10-1 to 10-4 of the present embodiment are installed in the kitchen, living room, master bedroom, and nursery respectively of a residence 24, and an alarm device 10-5 is also installed in an external garage 26.

Each of the alarm devices 10-1 to 10-5 comprises functionality for exchanging event signals with each other by wireless transmission and reception, and the five alarm devices 10-1 to 10-5 form a single group to monitor for fires throughout the entire residence 24.

If by some chance a fire occurs in the nursery of the residence 24, the alarm device 10-4 detects the fire and initiates a warning process. Detecting a fire and starting a warning process is called "alert activation" in an alarm device. When the alarm device 10-4 undergoes alert activation, the alarm device 10-4 functions as the linkage source, and to the other alarm devices 10-1 to 10-3 and 10-5 serving as the linkage destinations, wirelessly transmits an event signal indicating the fire alert. The other alarm devices 10-1 to 10-3 and 10-5, upon receiving the event signal indicating the fire alert from the alarm device 10-4 serving as the linkage source, perform alert behavior as linkage destinations.

As the audible alarm of the alarm device 10-4 serving as the linkage source, for example a siren followed by a voice message "The fire alarm has activated. Please verify." may be output continuously. On the other hand, the linkage destination alarm devices 10-1 to 10-3 and 10-5 continuously output a siren followed by a voice message "The fire alarm in another room has activated. Please verify."

In a state where the alarm devices 10-1 to 10-5 are outputting an audible alarm, if the alarm stop switch 20 provided on the alarm device shown in FIG. 1 is operated, processing to stop the audible alarm takes place.

Furthermore, the alarm devices 10-1 to 10-5 comprise failure monitoring functionality, and when a failure such as a low battery is detected, a warning sound, for example a beep, is output intermittently at for example one minute intervals to report that a failure has occurred. Moreover, the failure source alarm device where the failure is detected, wirelessly transmits an event signal indicating the failure to the other alarm devices, and in the other alarm devices, the same failure warning is output. As a result, when a failure is detected in any of the alarm devices, a failure warning is output from all of the alarm devices that constitute the group.

In addition, in the alarm device of the present embodiment, during monitoring, a communication test can be activated by, for example, operating the alarm stop switch 20. In the communication test, the test source alarm device which receives the communication test request by way of the switch operation or other means, transmits an event signal indicating the communication test to the other alarm devices. The test destination alarm devices, upon correctly receiving the event signal indicating the communication test from the test source alarm device, issues an announcement indicating a normal communication test. The announcement of a normal communication test may take the form of a voice message or an LED display operation, for example.

The communication destination alarm device, upon receiving the event signal indicating the communication test, measures the signal strength thereof and performs a comparison with a threshold strength set based on the sensitivity of the reception circuit section, for example, and announces a normal communication test if the threshold strength is exceeded. Furthermore, when announcing a normal communication test, a measure of the signal strength is announced at the same time.

In addition, the alarm device of the present embodiment, when a communication test has not been performed for a fixed time or longer, can issue an announcement urging that a communication test be performed.

Figure 3:
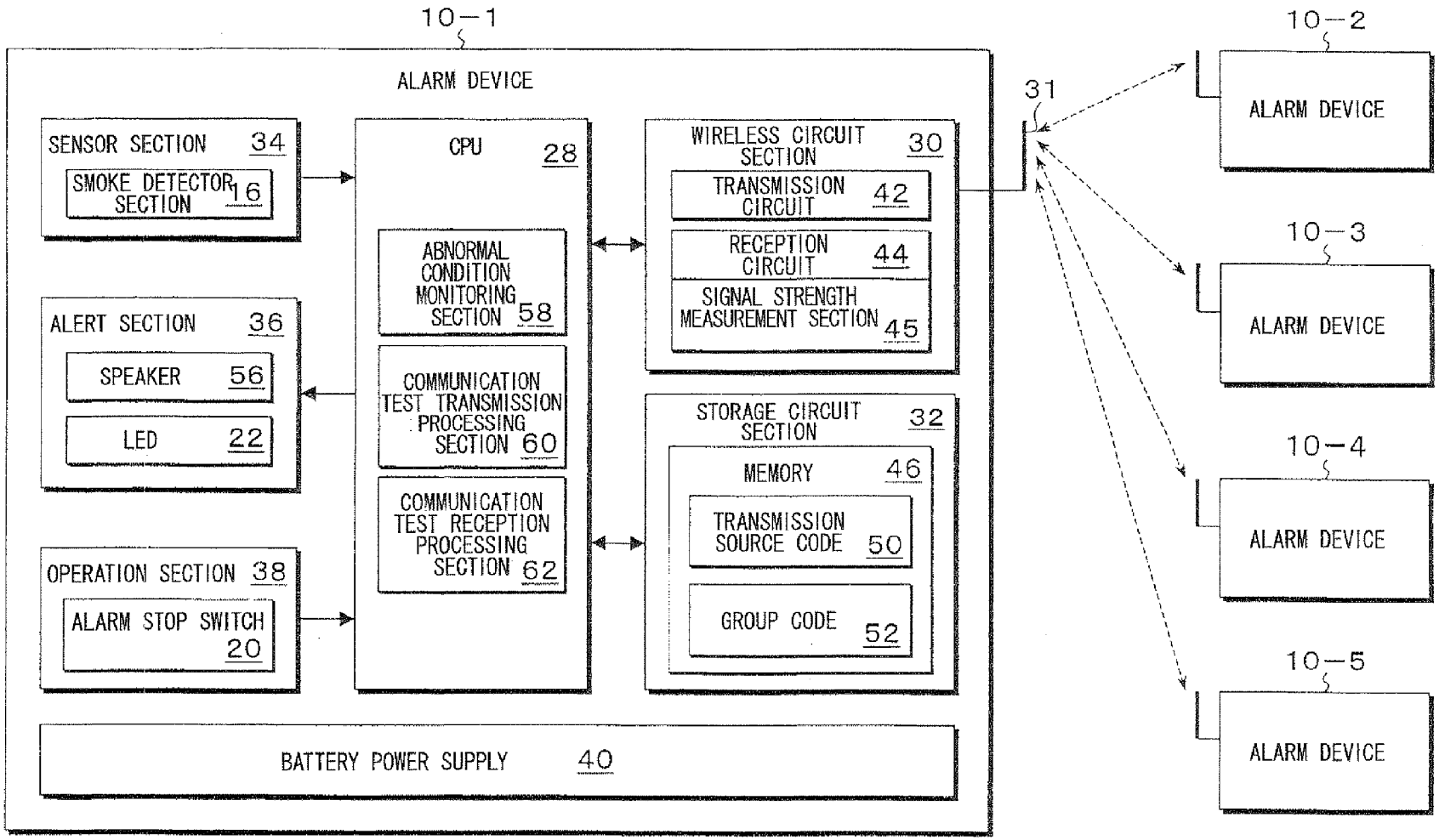
FIG. 3 is a block diagram showing the same alarm device.

FIG. 3 is a block diagram of the alarm device of the present embodiment. FIG. 3 shows in detail the circuit structure for the alarm device 10-1 of the five alarm devices 10-1 to 10-5 shown in FIG. 2.

The alarm device 10-1 comprises a CPU 28. To the CPU 28 are connected; a wireless circuit section 30 comprising an antenna 31, a storage circuit section 32, a sensor section 34, an alert section 36, an operation section 38, and a battery power supply 40.

In the wireless circuit section 30, a transmission circuit 42 and a reception circuit 44 are provided, enabling the wireless transmission and reception of event signals to and from the other alarm devices 10-2 to 10-5. As the wireless circuit section 30, within Japan for instance, a configuration is provided that conforms with STD-30 (a standard for wireless communication equipment in wireless stations for low power security systems) or STD-T67 (a standard for telemeters, telecontrol, and data transmission radio equipment for specified low power radio stations) which are known standards for specified low power radio stations in the 400 MHz band.

As the wireless circuit section 130, in locations other than Japan, this has contents that conform to the standards for allocated wireless base stations in that region.

For the reception circuit section 44 there is provided a signal strength measurement section 45, such that when an event signal is received from another alarm device 10-2 to 10-5, the signal strength thereof can be measured and the signal strength value can be read by the CPU 28 as needed.

In the storage circuit section 32, a memory 46 is provided. In the memory 46 are stored a transmission source code 50 which serves as an ID for identifying the alarm device, and a group code 52 for forming a group of a plurality of alarm devices as shown in FIG. 2 which perform linked alarm output. As the transmission source code 50, based on the estimated number of alarm devices to be supplied throughout the country, a 26 bit code is used, for example, thereby ensuring that the same code is not used more than once.

The group code 52 is a code assigned in common to each of the plurality of alarm devices that form a group. When the group code contained in the event signal received from one of the other alarm devices by the wireless circuit section 30 matches the group code 52 registered in the memory 46, this event signal is received and processed as a valid signal.

In the present embodiment, the memory 46 is used in the storage circuit section 32, but by providing a DIP switch instead of the memory 46, the transmission source code 50 and the group code 52 can be set by the DIP switch. When the transmission source code 50 and the group code 52 have a short code length (bit count), a storage circuit section 32 with DIP switches is desired.

In the sensor section 34, in the present embodiment a smoke detector section 16 is provided. In the sensor section 34, other than the smoke detector section 16, a thermistor which detects the heat of a fire may be provided. Furthermore, in the case of an alarm device that monitors for gas leaks, a gas leak sensor is provided in the sensor section 34.

In the alert section 36, a speaker 58 and an LED 22 are provided. The speaker 58 outputs a voice message or audible alarm from a voice synthesizer circuit section (not shown). The LED 22, by blinking, flashing, illuminating, or similar, indicates a failure or an abnormal condition such as a fire.

In the operation section 38, an alarm stop switch 20 is provided. The alarm stop switch 20 functions as a test switch when operated during monitoring, and if the alarm device 10-1 is normal, a siren followed by the voice message "The fire alarm has activated. Please verify." is output once, at a lower volume than a fire alarm. By operating the alarm stop switch 20 during an alarm for a fire or the like, the audible alarm being emitted from the alarm device 10-1 can be stopped.

In the present embodiment, when the alarm stop switch 20 is operated during monitoring, a test operation is performed, and concurrently a judgment is made that a communication test request has been issued, and a communication test operation is performed.

As the battery power supply 40, for example an alkaline battery with a predetermined number of cells is used. As for battery capacity, a battery life of approximately 10 years is ensured by reducing the power consumption of the overall circuitry in the alarm device 10-1 including the wireless circuit section 30.

In the CPU 28, as functionality realized by program execution, an abnormal condition monitoring section 58, a communication test transmission processing section 60, and a communication test reception processing section 62 are provided.

The abnormal condition monitoring section 58, when a fire is detected by the smoke detector section 16 provided in the sensor section 34, repeatedly outputs an audible alarm indicating a linkage source (for example a siren followed by a voice message "The fire alarm has activated. Please verify.") from the speaker 56 of the alert section 36, and transmits an event signal indicating a fire alert, to the other alarm devices 10-2 to 10-5 from the antenna 31 by way of the transmission circuit 42 of the wireless circuit section 30.

The abnormal condition monitoring section 58, upon receiving an event signal indicating a fire alert from any of the other alarm devices 10-2 to 10-5 by means of the reception circuit 44 of the wireless circuit section 30, repeatedly outputs an audible alarm indicating a linkage destination (for example a siren followed by a voice message "The fire alarm in another room has activated. Please verify.") from the speaker 56 of the alert section 36.

Here, when the abnormal condition monitoring section 58 detects a fire and outputs an audible alarm as a linkage source, the LED 22 of the alert section 36 flashes, for example. On the other hand, when the linkage destination audible alarm is output, the LED 22 of the alert section 36 blinks, for example. As a result, the appearance of the LED 22 during a linkage source alarm and a linkage destination alarm can be distinguished. Naturally, the same flashing or blinking behavior can be used by the LED 22 for alarms issued by the linkage source and the linkage destination.

In addition, when the abnormal condition monitoring section 58 detects a low battery failure based on a drop in the voltage of the battery power supply 40, an audible failure alarm is output as a low battery alarm in the form of a short beep at one minute intervals, for example. In this case, an event signal indicating the failure can be transmitted to the other alarm devices 10-2 to 10-5, thereby enabling linked alarm output for low battery failures.

The communication test transmission processing section 60, when a communication test request is issued by operation of the alarm stop switch 20 or the like during monitoring, transmits an event signal indicating the communication test to the other alarm devices 10-2 to 10-5 from the transmission circuit 42 of the wireless circuit section 30. Regarding the communication test request issued to the communication test transmission processing section 60, a judgment may be made that a communication test request is received and an event signal indicating the communication test transmitted to the other alarm devices, not just when the alarm stop switch 20 is operated, but when a fixed time has elapsed from the occurrence of a particular event such as switch operation or a fire alarm, or when a signal is received from another alarm device.

The communication test reception processing section 62, upon receiving an event signal indicating a communication test from any of the other alarm devices 10-1 to 10-5, announces the reception status of this event signal. For example the communication test reception processing section 62, upon receiving an event signal indicating a communication test from another alarm device, reads the signal strength as measured by the signal strength measurement section 45 provided in the reception circuit 44, and announces a normal test result if the measured signal strength exceeds a predetermined threshold strength.

The threshold strength used to judge the signal strength is derived by adding a predetermined value to the reception sensitivity of the reception circuit 44. Reception sensitivity means the minimum signal strength that the reception circuit 44 can receive normally, for example −110 dBm. A predetermined value, for example 30 dB, is added to this reception sensitivity as a tolerance value which, even if signal conditions deteriorate within tolerance, permits linked alarm output by the normal reception of an event signal indicating an abnormal condition such as a fire, to give the following threshold strength:

$$(-110\text{dBm}+30\text{dB})=-80\text{dBm}$$

To announce a normal test result, for example the LED 22 provided in the test destination alarm device blinks or flashes. When the user attends the location of the test destination alarm device and operates the alarm stop switch 20 while the LED 22 is blinking or flashing, a voice message indicating a normal communication test may be output.

On the other hand, if an event signal indicating a communication test is not received, the abnormal test result of the test destination alarm device can be ascertained from the fact that the LED 22 is not blinking or flashing. In this case, the communication test can be repeated after changing the installed location of the test destination alarm device, for example, until a normal communication test result is announced.

Furthermore, the communication test reception processing section 62, upon judging a normal test when the measured signal strength meets or exceeds the threshold strength, may output a voice message which reflects the measured signal strength. This voice message announces the signal strength in terms of, for example, three separate tiers, weak, moderate, and strong. In some cases, though the communication test is normal the signal strength may be weak, and by becoming aware of this situation, and changing the installation location of the test destination alarm device then repeating the communication test, the signal environment can be improved to obtain a moderate or strong signal strength.

The communication test reception processing section 62, when a communication test has not been performed for a fixed time or longer, issues an announcement urging that a communication test be performed. As the fixed time after which a communication test is required, for example one month is set. The time elapsed since the previous communication test is monitored, and if one month passes without a communication test taking place, a voice message urging that a communication test be performed is output.

By outputting this message urging a communication test, a state in which a long time passes without a communication test can be avoided. Moreover, a situation whereby, despite normal linked alarm output being possible at installation, a deterioration in the signal environment due to changes in the installation environment or the like prevents linked alarm output from taking place, can be reliably avoided.

The circuit structure and functionality of this alarm device 10-1 also applies to the other alarm devices 10-2 to 10-5, but the transmission source code 50 stored in the memory 46 is unique to each alarm device.

Figure 4:
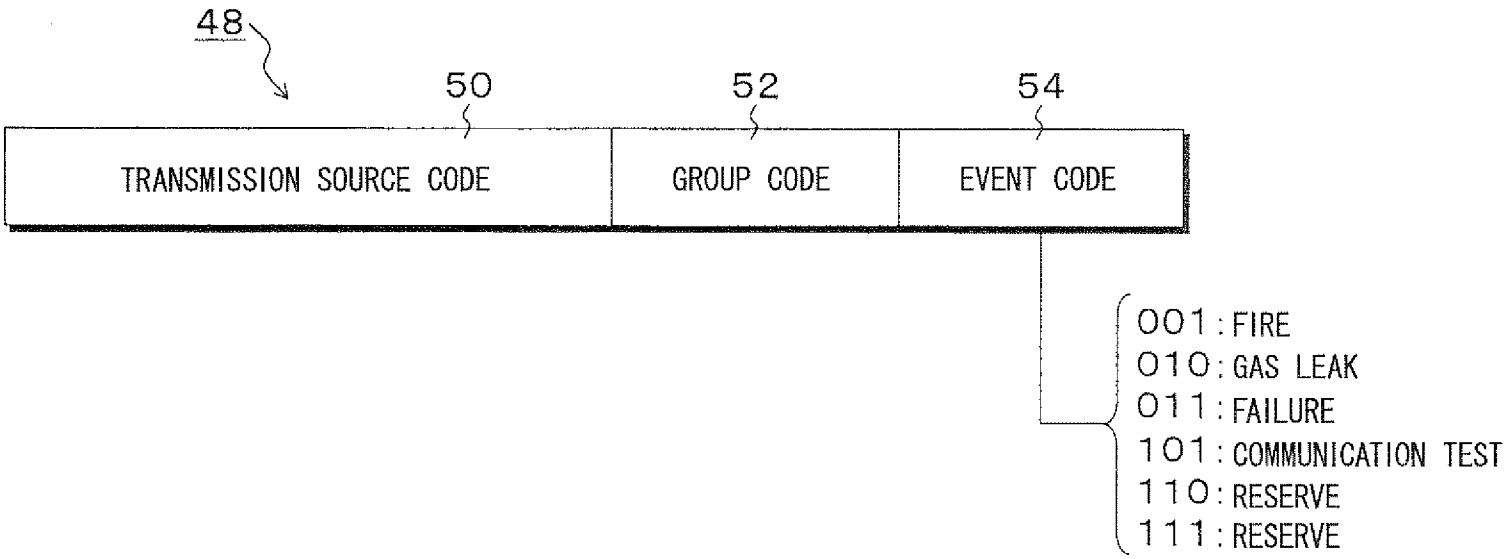
FIG. 4 is an explanatory drawing showing the format of an event signal used in the same embodiment.

FIG. 4 is an explanatory drawing showing the format of an event signal used in the present embodiment. As shown in FIG. 4, the event signal 48 comprises a transmission source code 50, a group code 52, and an event code 54. The transmission source code 50 is for example a 26 bit code. The group code 52 is for example, an 8 bit code, and the same group code is assigned to alarm devices in the same group, for example the five alarm devices 10-1 to 10-5 in FIG. 3.

As the group code 52, as an alternative to setting the same group code for the alarm devices in a given group, a group code which is determined by a calculation between a predetermined reference code common to the alarm devices which form a group and a unique transmission source code specific to each alarm device may be set, and thereby a different group code may be used for each alarm device.

The event code 54 is a code that represents the content of the event, such as an abnormal condition like a fire or a gas leak, or a failure. In the present embodiment a 3 bit code is used; for example, "001" is a fire, "010" is a gas leak, "011" is a failure, and "101" is a communication test, with the remaining kept in reserve.

By increasing the number of bits of the event code 54 to 4 bits or 5 bits when the number of event types increases, the event code can represent a plurality of event types.

Figure 5:
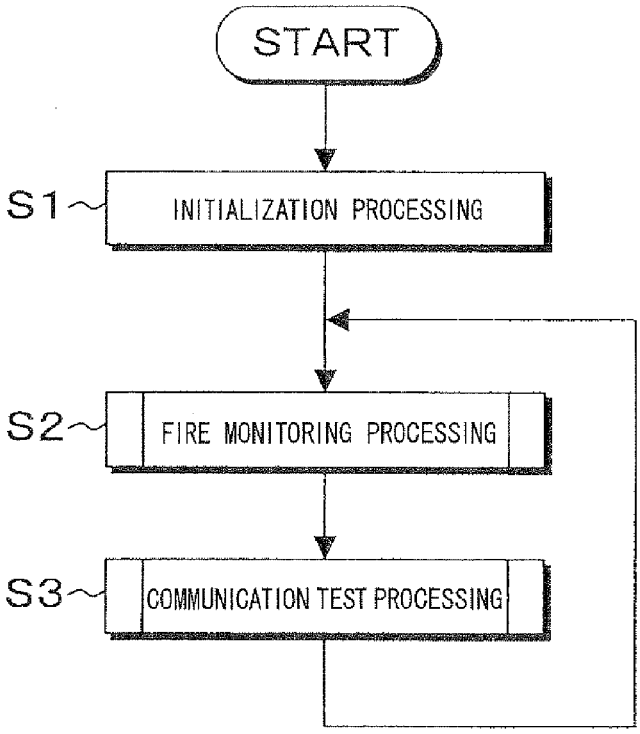
FIG. 5 is a flowchart showing the basic processing in the same embodiment.

FIG. 5 is a flowchart showing the basic processing in the present embodiment. In FIG. 5, when the power is switched on by activating the battery power supply housed in the alarm device, initialization processing is performed in step S1. This initialization processing includes grouping processing for fowling a group from the alarm devices 10-1 to 10-5 shown in FIG. 2, and in the memory 46 of the alarm devices 10-1 to 10-5, for example, which constitute the group, the same group code 52 is set. Grouping may be performed at the factory, or by the user.

Next, on a repeated basis, fire monitoring processing is executed in step S2, and then processing for executing a communication test is repeated in step S3.

Figure 6:
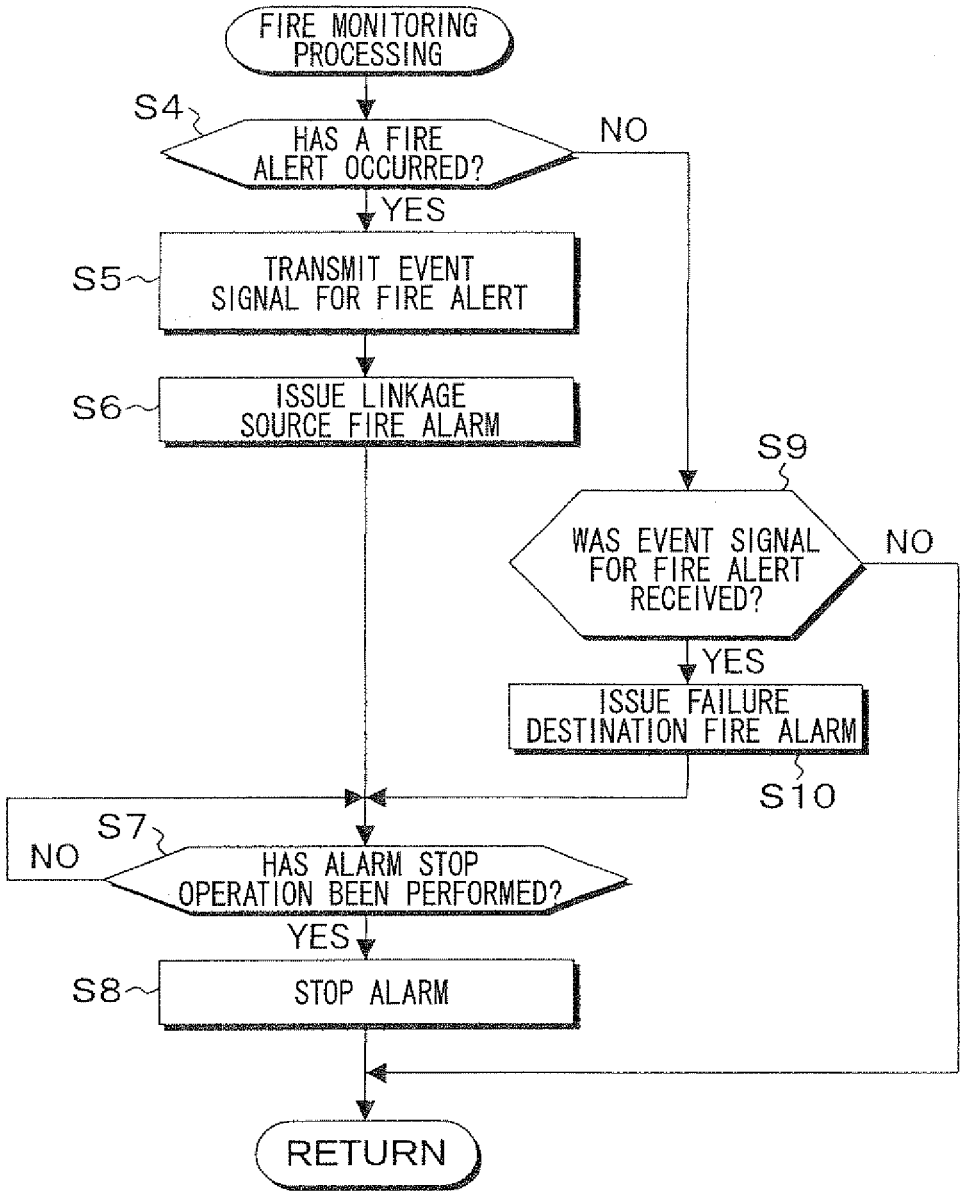
FIG. 6 is a flowchart showing in detail the fire monitoring processing in step S2 of FIG. 5.

FIG. 6 is a flowchart showing in detail the fire monitoring processing in step S2 of FIG. 5. In FIG. 6, first in step S4 a judgment is made by the smoke detector section 16 provided in the sensor section 34 as to whether or not a fire alert is warranted. If a judgment is made that a fire alert is warranted, the flow advances to step S5, and an event signal indicating the fire alert is transmitted to the other alarm devices. Then, in step S6 a siren followed by a voice message "The fire alarm has activated. Please verify." is output continuously as a linkage source fire alarm, and the LED 22 begins to flash.

If a judgment is made in step S7 that the alarm stop switch 20 was operated during output of the fire alarm, the flow advances to step S8 and the alarm is stopped. If the alarm is stopped but smoke remains in the smoke detector section 16, alarm output is performed again after a predetermined time, for example 14 minutes.

On the other hand, if a fire alert is not judged to be warranted in step S4, the flow advances to step S9. In step S9, a judgment is made as to whether or not an event signal indicating a fire alert has been received from another alarm device, and if such an event signal has been received, the flow advances to step S10 and a siren followed by a voice message "A fire alarm in another room has activated. Please verify." is output continuously as a linkage destination fire alarm. In this case also, the linkage destination alarm is stopped in step S8 if an alarm stop operation is identified in step S7.

Figure 7:
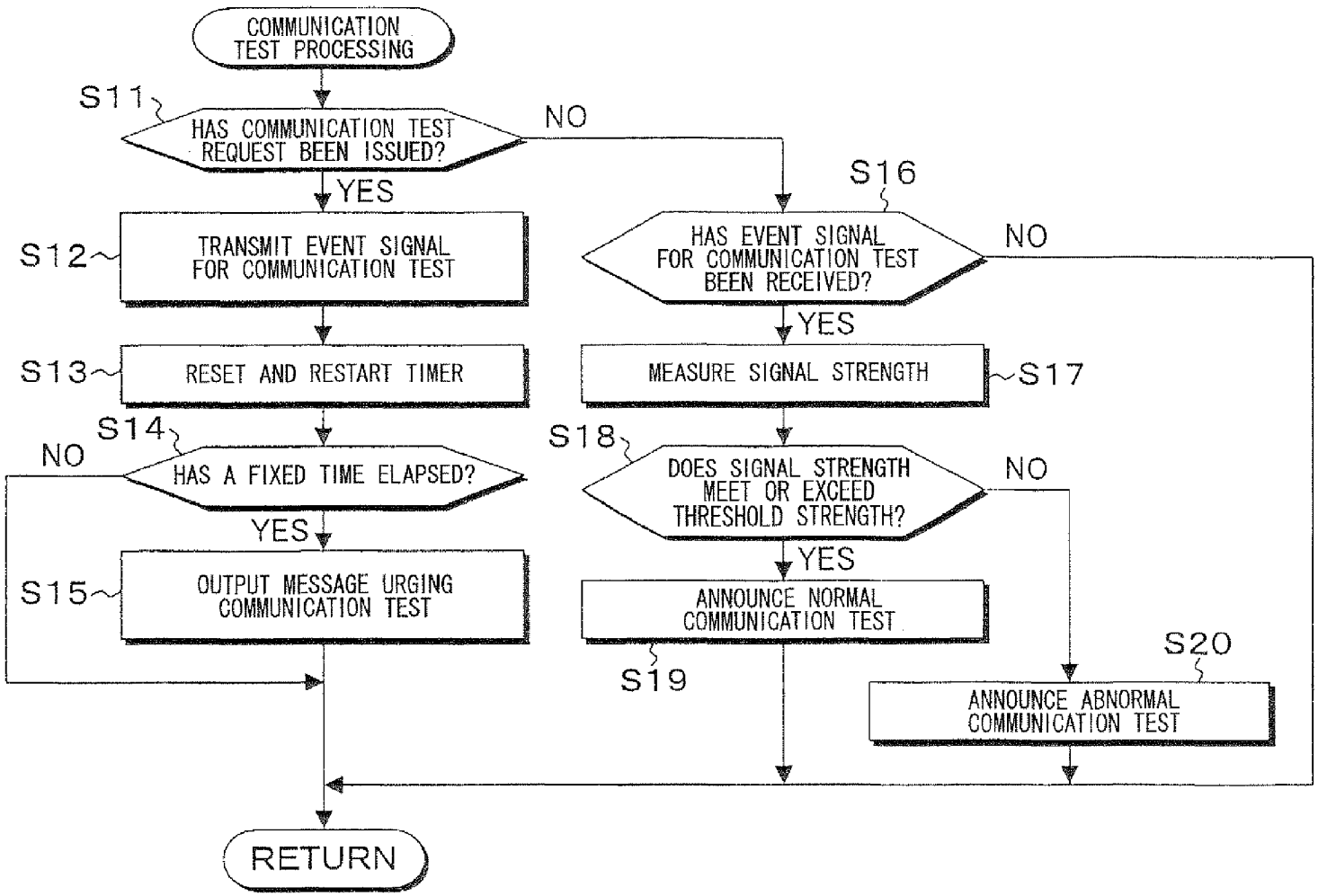
FIG. 7 is a flowchart showing in detail the communication test processing in step S3 of FIG. 5.

FIG. 7 is a flowchart showing in detail the communication test processing in step S3 of FIG. 5. In FIG. 7, in the communication test processing, a judgment is made in step S11 as to whether or not a communication test request has been issued. If the alarm stop switch 20 is operated during monitoring, a judgment is made that a communication test request has been issued, and the flow advances to step S12 where an event signal indicating the communication test is transmitted to the other alarm devices.

Then, the timer is reset and restarted in step S13. In step S14, a judgment is made as to whether or not the time elapsed on the timer has reached a fixed time, for example one month or thereabouts, and if a judgment is made that the fixed time has elapsed, the flow advances to step S15 and a message urging a communication test is output.

A configuration may be used in which the message urging that a communication test be performed is output only during daylight hours, not during evening hours when users are asleep. Furthermore, output of the message, to avoid consuming more power than necessary, is performed a limited number of times, for example once an hour three consecutive times, and if no communication test request is received during this interval, the timer is reset and restarted.

On the other hand, if a judgment is made in step S11 that no communication test request has been received, the flow advances to step S16 and a judgment is made as to whether or not an event signal indicating a communication test was received from another alarm device. If a judgment is made that such an event signal was received, the flow advances to step S17. At this time, the signal strength measured by the signal strength measurement section 45 is retrieved as the measurement results. Then in step S18 the measured signal strength is compared against a threshold strength set in advance, and if a judgment is made that the threshold strength is met or exceeded, the flow advances to step S19 and a normal communication test is announced.

This announcement of a normal communication test takes the form of the LED 22 blinking or flashing, and in this state if operation of the alarm stop switch 20 is identified a voice message announcing the normal communication test is output. As this voice message, a voice message declaring the relevant signal strength in terms of, for example, three separate tiers: weak, moderate, and strong, may be output. Naturally, the announcement may consist only of blinking or flashing of the LED 22.

On the other hand, if a judgment is made in step S18 that the signal strength is less than the threshold strength, the flow advances to step S20 and an abnormal communication test is announced. The condition for announcing an abnormal communication test in step S20 is that the signal strength is below the threshold strength, but equal to or greater than the reception sensitivity of the reception circuit 44 so that the event signal indicating the communication test can be received. When the signal strength is less than the reception sensitivity, because the event signal cannot be received, an abnormal communication test is not announced in step S20, nor is a normal communication test announced.

Second Embodiment

Figure 8:
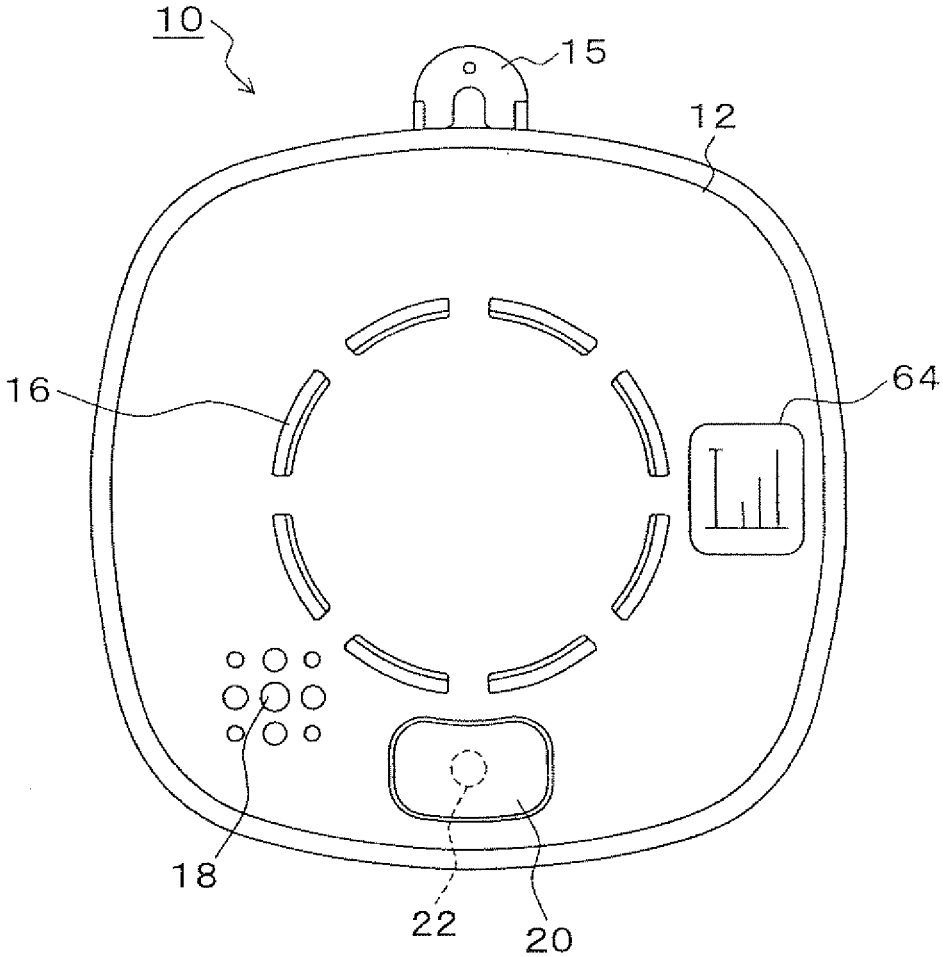
FIG. 8 shows an alarm device according to a second embodiment of the present invention, as a front view of the alarm device comprising a signal strength display section.

FIG. 8 shows an alarm device according to a second embodiment of the present invention, as a front view of an alarm device comprising a signal strength display section.

The construction of the alarm device 10 in FIG. 8 is fundamentally the same as the construction of the first embodiment, but in the present embodiment, a signal strength display section 64 is added to the right side of the cover 12. As the signal strength display section 64, a small scale LCD unit is used, which displays an antenna symbol next to a bar graph of three bars whose respective lengths indicate a weak, moderate, or strong signal strength. The display in the figure corresponds to a strong signal strength, where three bars are displayed. When the signal strength is moderate, the bar graph displays only the smaller two bars, and when the signal strength is weak only the smallest bar is displayed. In addition, in the event of abnormal communication, the bar graph display disappears, leaving only the antenna symbol.

Naturally, the signal strength display in the signal strength display section 64 may, instead of a bar graph, take the form of a number, letter, or appropriate diagram representing the signal strength, and may comprise more or fewer than three tiers.

In the present embodiment, an example of an alarm device which detects fires is used, but the alarm stop processing of the present embodiment can be applied without modification to alarm devices that detect other relevant abnormal conditions, such as gas leak alarms, and burglar alarms. Moreover, the present embodiment is applicable not just to residential use, but also to alarm devices with a range of applications in buildings and offices.

Furthermore, in the communication test reception processing section 62 of the present embodiment, the signal strength is announced in, for example, three tiers when the signal strength meets or exceeds the threshold strength, but this function need only be provided selectively.

Moreover, the feature which urges that a communication test be performed when no communication test has been performed for a fixed time or longer also need only be provided selectively.

Furthermore, the present embodiment uses an example in which the sensor section and alarm output processing section are integrated with the alarm device, but as another embodiment, an alarm device in which the sensor section and the alarm output processing section are provided as a separate unit from the alarm device can also be used.

Moreover, the present invention is not limited to the present embodiment, and appropriate variations that retain the objectives and advantages thereof are included within its scope. Furthermore, the invention is not limited on the basis of the numerical values indicated in the embodiments.

Third Embodiment

Figure 9A:
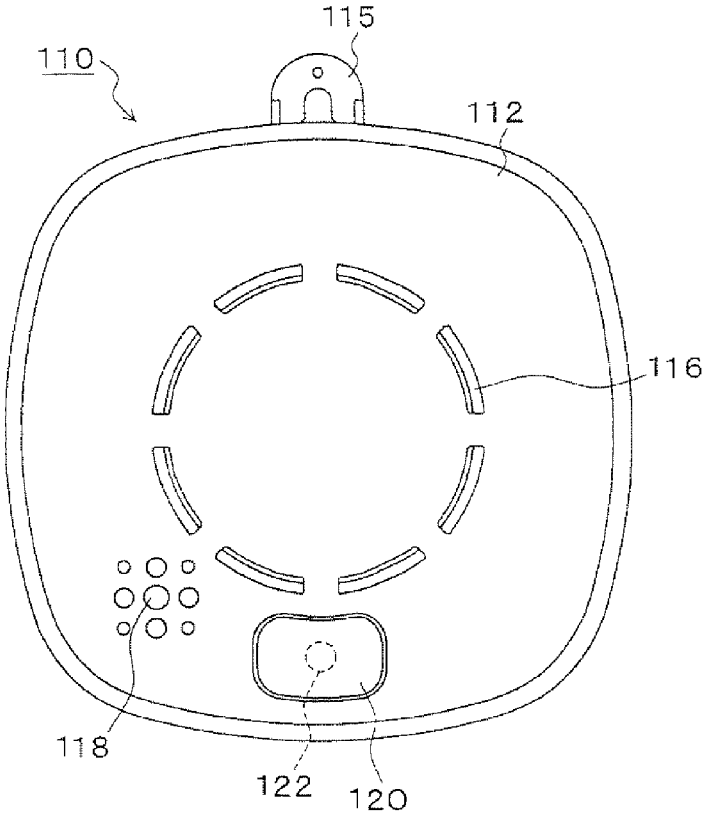
FIG. 9A is a front view showing the outward appearance of an alarm device according to a third embodiment of the present invention.
Figure 9B:
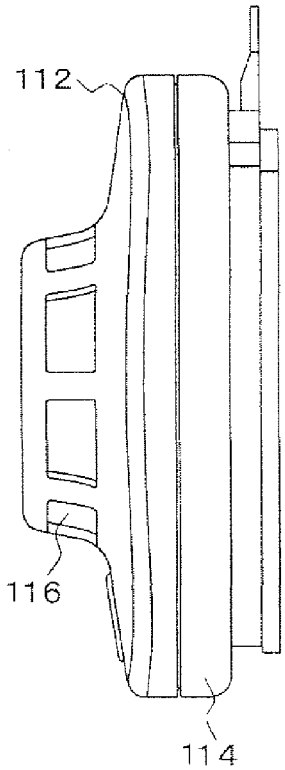
FIG. 9B is a side view of the outward appearance of the same alarm device.

FIG. 9A and FIG. 9B are explanatory drawings showing the outward appearance of a wireless alarm device according to a third embodiment of the present invention, wherein FIG. 9A is a front view and FIG. 9B a side view.

As shown in FIG. 9A and FIG. 9B, an alarm device 110 of the present embodiment comprises a cover 112 and a main unit 114. At the center of the cover 112, a smoke detector section 116, with openings through which smoke can enter formed around the periphery, is disposed, which detects a fire when smoke from the fire reaches a predetermined concentration.

At the lower left side of the smoke detector section 116 provided in the cover 112, a sound hole 118 is provided. A speaker (not shown in the drawing) is housed behind this such that an audible alarm or voice message can be output. Underneath the smoke detector section 116, an alarm stop switch 120 is provided. The alarm stop switch 120 also functions as a test switch.

Inside the alarm stop switch 120, an LED 122 is installed as illustrated by the dashed line. When the LED 122 is lit, the lit status of the LED 122 can be visually recognized from outside through the switch cover of the alarm stop switch 120.

Moreover a mounting hook 115 is provided at the top of the back side of the main unit 114, and by screwing a screw or the like into a wall of the room where the alarm device 110 is to be installed, and fitting the mounting hook 115 over this screw, the alarm device 110 can be mounted to the wall surface.

In the alarm device 110 of FIG. 9A and FIG. 9B, an example of an alarm device which comprises a smoke detector section 116 and detects the smoke produced by fire is used. However, alternatively, an alarm device comprising a thermistor which detects the heat produced by a fire, or an alarm device which detects not fire but gas leaks are also included in the scope of the present invention.

Figure 10:
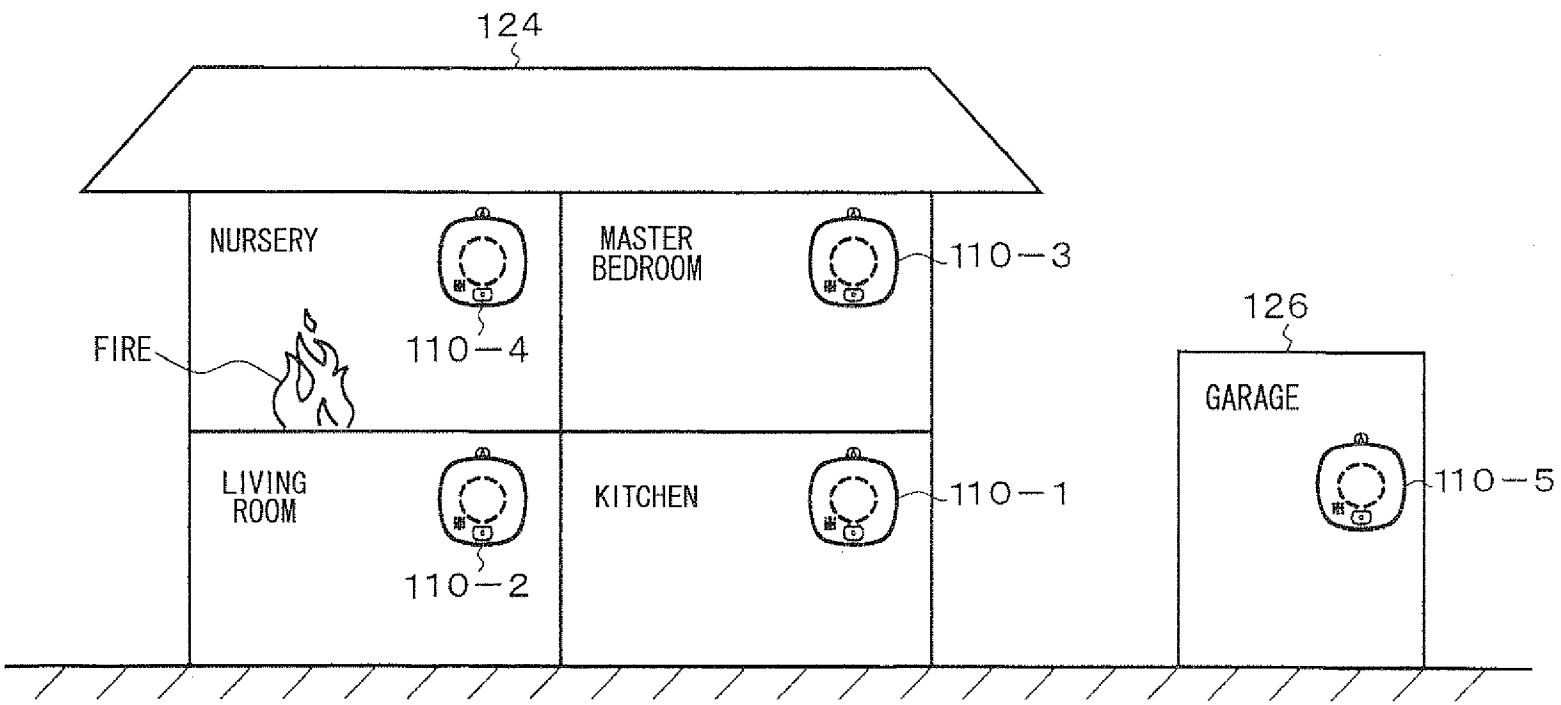
FIG. 10 is an explanatory drawing showing a situation where alarm devices are installed in a residence.

FIG. 10 is an explanatory drawing showing a situation in which alarm devices of the present embodiment are installed in a residence. In the example in FIG. 10, alarm devices 110-1 to 110-4 of the present embodiment are installed in the kitchen, living room, master bedroom, and nursery respectively provided in a residence 124, and an alarm device 110-5 is also installed in an external garage 126.

Each of the alarm devices 110-1 to 110-5 comprises functionality for exchanging event signals with each other by wireless transmission and reception. The five alarm devices 110-1 to 110-5 form a single group to monitor for fires throughout the entire residence 124.

If by some chance a fire occurs in the nursery of the residence 124, the alarm device 110-4 detects the fire and initiates a warning process. Detecting a fire and starting a warning process is called "alert activation" in an alarm device. When the alarm device 110-4 undergoes alert activation, the alarm device 110-4 functions as the linkage source, and to the other alarm devices 110-1 to 110-3 and 110-5 serving as the linkage destinations, wirelessly transmits an event signal indicating the fire alert. The other alarm devices 110-1 to 110-3 and 110-5, upon receiving the event signal indicating the fire alert from the alarm device 110-4 serving as the linkage source, perform alert behavior as linkage destinations.

Here, as the audible alarm of the alarm device 110-4 serving as the linkage source, for example a siren followed by a voice message "The fire alarm has activated. Please verify." may be output continuously. On the other hand, the linkage destination alarm devices 110-1 to 110-3 and 110-5 continuously output a siren followed by a voice message "The fire alarm in another room has activated. Please verify."

In a state where the alarm devices 110-1 to 110-5 are outputting an audible alarm, if the alarm stop switch 120 provided on the alarm device shown in FIG. 9A and FIG. 9B is operated, processing to stop the audible alarm takes place.

The alarm devices 110-1 to 110-5 comprise failure monitoring functionality, and when a failure is detected, a warning sound, for example a beep, is output intermittently at predetermined intervals to report that a failure has occurred. Moreover, the failure source alarm device where the failure is detected, wirelessly transmits an event signal indicating the failure to the other alarm devices, and in the other alarm devices, the same failure warning is output. As a result, when a failure is detected in any of the alarm devices, a failure warning is output from all of the alarm devices that constitute the linked alarm group.

The fault alarm output from the alarm device can be stopped by operating the alarm stop switch 120. In the present embodiment, if an alarm stop operation is performed during linked failure alarm output, processing takes one of the following forms.

(1) When a failure is detected in an arbitrary alarm device, a failure alarm is output by all of the alarm devices in the group, and when a stop operation is performed in an arbitrary alarm device, the failure source is announced by the failure source alarm device, and the audible alarm is stopped in the other alarm devices.

(2) When a failure is detected in an arbitrary alarm device, all the alarm devices in the group output failure alarms in sequence, and when a stop operation is performed in an arbitrary alarm device, the failure source is announced by the failure source alarm device, and the audible alarm is stopped in the other alarm devices.

(3) When a failure is detected in an arbitrary alarm device, only the alarm device designated in advance as a failure representative alarm device outputs a failure alarm, and when a stop operation is performed in an arbitrary alarm device, the failure source is announced by the failure source alarm device.

Moreover, in the present embodiment, of the failures detected and reported by an alarm device, a low battery warning which detects and warns of a reduction in the battery voltage is the most common, and others include warnings of pertinent failures such as the failure of a sensor in a smoke detector section or the like.

A low battery is detected when the battery voltage drops to the minimum voltage required for the alarm device to operate normally for a span of 72 hours, whereupon an audible alarm in the form of a short beep at one minute intervals, for example, is output. In the description below, a low battery alarm is used as an example of a failure alarm.

Figure 11:
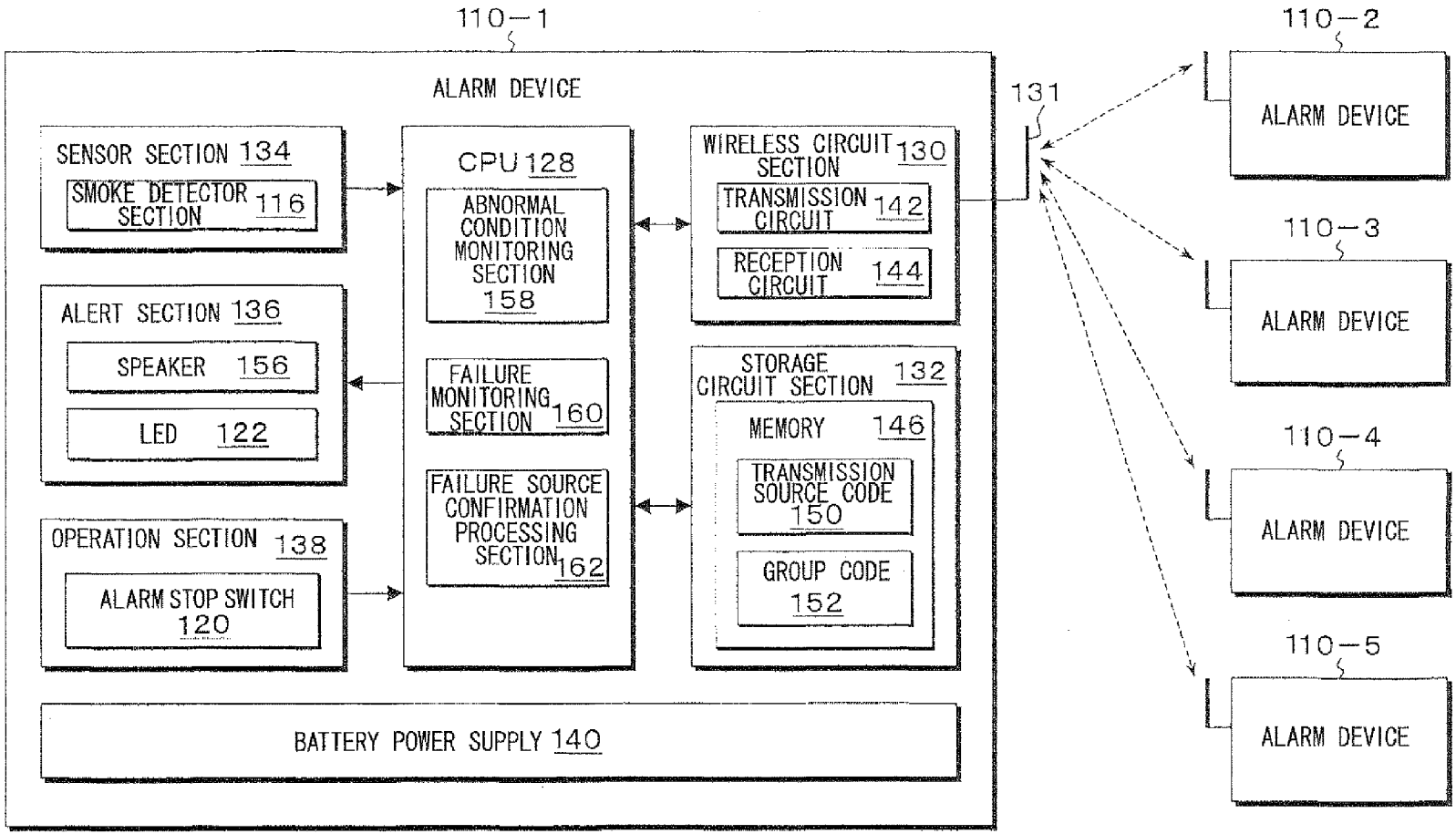
FIG. 11 is a block diagram showing the same alarm device.

FIG. 11 is a block diagram of the alarm device of the present embodiment. FIG. 10 shows in detail the circuit structure for the alarm device 110-1 of the five alarm devices 110-1 to 110-5 shown in FIG. 10.

The alarm device 110-1 comprises a CPU 128. To the CPU 128 are connected; a wireless circuit section 130 comprising an antenna 131, a storage circuit section 132, a sensor section 134, an alert section 136, an operation section 138, and a battery power supply 140.

In the wireless circuit section 130, a transmission circuit 142 and a reception circuit 144 are provided, enabling the wireless transmission and reception of event signals to and from the other alarm devices 110-2 to 110-5. As the wireless circuit section 130, within Japan for instance, a configuration is provided that conforms with STD-30 (a standard for wireless communication equipment in wireless stations for low power security systems) or STD-T67 (a standard for telemeters, telecontrol, and data transmission radio equipment for specified low power radio stations) which are known standards for specified low power radio stations in the 400 MHz band.

As the wireless circuit section 130, in locations other than Japan, this has contents that conform to the standards for allocated wireless base stations in that region.

In the storage circuit section 132, a memory 146 is provided. In the memory 146 are stored a transmission source code 150 which serves as an ID for identifying the alarm device, and a group code 152 for forming a group of a plurality of alarm devices as shown in FIG. 10 which perform linked alarm output. As the transmission source code 150, based on the estimated number of alarm devices to be supplied throughout the country, a 26 bit code is used, for example, thereby ensuring that the same code is not used more than once.

The group code 152 is a code assigned in common to each of the plurality of alarm devices that form a group. When the group code contained in the event signal received from one of the other alarm devices by the wireless circuit section 130 matches the group code 152 registered in the memory 146, this event signal is received and processed as a valid signal.

In the present embodiment, the memory 146 is used in the storage circuit section 132, but by providing a DIP switch instead of the memory 146, the transmission source code 150 and the group code 152 can be set by the DIP switch. When the transmission source code 150 and the group code 152 have a short code length (bit count), a storage circuit section 132 with DIP switches is desired.

In the sensor section 134, in the present embodiment a smoke detector section 116 is provided. In the sensor section 134, other than the smoke detector section 116, a thermistor which detects the heat of a fire may be provided. Furthermore, in the case of an alarm device that monitors for gas leaks, a gas leak sensor is provided in the sensor section 134.

In the alert section 136, a speaker 156 and an LED 122 are provided. The speaker 156 outputs a voice message or audible alarm from a voice synthesizer circuit section (not shown). The LED 122, by blinking, flashing, illuminating, or similar, indicates a failure or an abnormal condition such as a fire.

In the operation section 138, an alarm stop switch 120 is provided. By operating the alarm stop switch 120, the audible alarm being emitted from the alarm device 110-1 can be stopped. The alarm stop switch 120 also functions as a test switch in the present embodiment.

The alarm stop switch 120 is enabled when an audible alarm is being output from the alert section 136 through the speaker 156. On the other hand, in the normal monitoring status in which no audible alarm is being output, the alarm stop switch 120 functions as a test switch, and when the test switch is pressed, a voice message or the like for testing purposes is output from the alert section 136.

As the battery power supply 140, for example an alkaline battery with a predetermined number of cells is used, and as for battery capacity a battery life of approximately 10 years is ensured by reducing the power consumption of the overall circuitry in the alarm device 110-1 including the wireless circuit section 130.

In the CPU 128, as functionality realized by program execution, an abnormal condition monitoring section 158, a failure monitoring section 160, and a failure source confirmation processing section 162 are provided.

The abnormal condition monitoring section 158, when a fire is detected by the smoke detector section 116 provided in the sensor section 134, repeatedly outputs an audible alarm indicating a linkage source (for example a siren followed by a voice message "The fire alarm has activated. Please verify") from the speaker 156 of the alert section 136, and transmits an event signal announcing a fire, to the other alarm devices 110-2 to 110-5 from the antenna 131 by way of the transmission circuit 142 of the wireless circuit section 130.

Moreover, the abnormal condition monitoring section 158, upon receiving an event signal indicating a fire alert from any of the other alarm devices 110-2 to 110-5 by means of the reception circuit 144 of the wireless circuit section 130, repeatedly outputs an audible alarm indicating a linkage destination (for example a siren followed by a voice message "The fire alarm in another room has activated. Please verify.") from the speaker 156 of the alert section 136.

Here, when the abnormal condition monitoring section 158 detects a fire and outputs an audible alarm as a linkage source, the LED 122 of the alert section 136 flashes, for example. On the other hand, when the linkage destination audible alarm is output, the LED 122 of the alert section 136 blinks, for example. As a result, the appearance of the LED 122 during a linkage source alarm and a linkage destination alarm can be distinguished. Naturally, the same flashing or blinking behavior can be used by the LED 122 for alarms issued by the linkage source and the linkage destination.

When the failure monitoring section 160 detects a low battery failure due to a drop in the voltage of the battery power supply 140, an audible failure alarm is output by outputting a low battery alarm in the form of a short beep at one minute intervals, for example, and an event signal indicating the failure is transmitted to the other alarm devices 110-2 to 110-5.

Furthermore, the failure monitoring section 160, upon receiving an event signal indicating a failure from any of the other alarm devices 110-2 to 110-5, performs linked output of an audible failure alarm by intermittently emitting the low battery alarm in the same manner. When reporting this low battery at a linkage destination, the LED 122 may blink in unison with the audible alarm.

The failure source confirmation processing section 162, if operation of the alarm stop switch 120 is detected during output of an audible low battery failure alarm, transmits an event signal for failure source confirmation to the other alarm devices 110-2 to 110-5. If the alarm device that detects operation of the alarm stop switch 120 is itself the failure source, the audible low battery failure alarm switches to an audible announcement indicating the failure source. In this case, an event signal for failure source confirmation is not transmitted to the other alarm devices 110-2 to 110-5.

On the other hand, when the failure source confirmation processing section 162 receives an event signal for failure source confirmation from one of the other alarm devices 110-2 to 110-5, and is itself the failure source, the audible low battery failure alarm switches to an audible alarm indicating the failure source.

As the audible alarm indicating the failure source, an announcement which is appropriately differentiated from a low battery alarm is used, such as outputting the voice message "Low battery was detected. Please replace battery.", increasing the volume of the audible alarm, or causing the LED 122 to blink or flash.

The circuit section provided in such an alarm device 110-1 also applies to the other alarm devices 110-2 to 110-5, but the transmission source code 150 stored in the memory 146 is unique to each alarm device.

Figure 12:
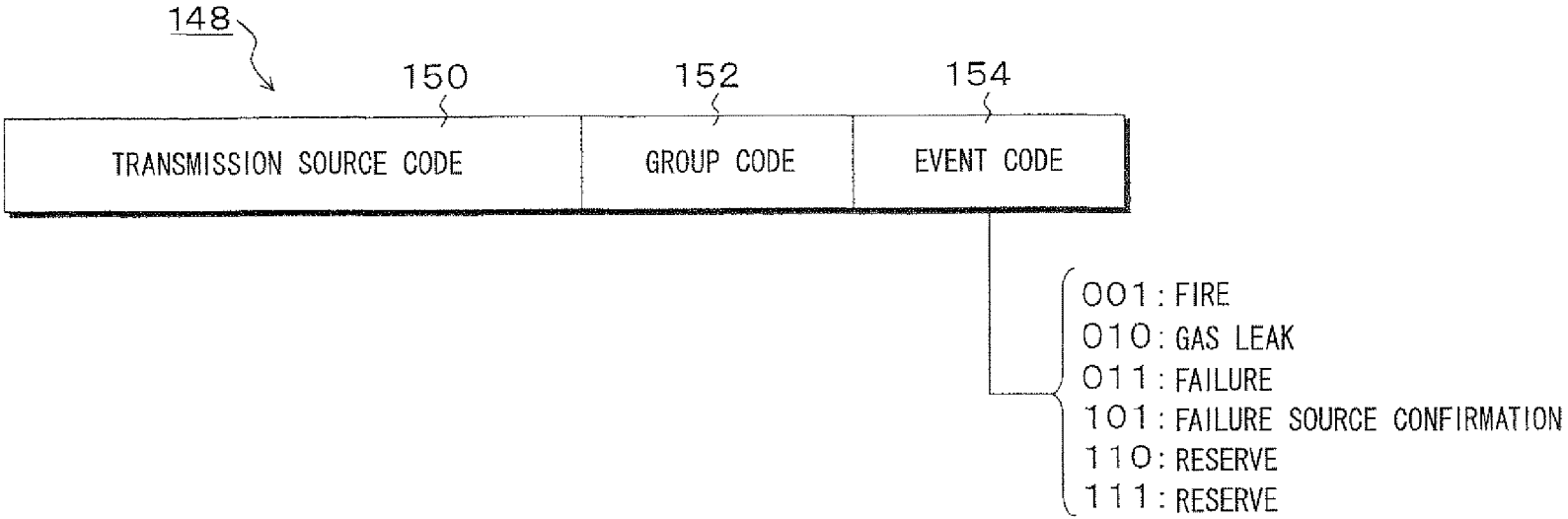
FIG. 12 is an explanatory drawing showing the format of an event signal used in the same embodiment.

FIG. 12 is an explanatory drawing showing the format of an event signal used in the present embodiment. As shown in FIG. 12, the event signal 148 comprises a transmission source code 150, a group code 152, and an event code 154. The transmission source code 150 is for example a 26 bit code. The group code 152 is for example, an 8 bit code, and the same group code is assigned to alarm devices in the same group, for example the five alarm devices 110-1 to 110-5 in FIG. 11.

As the group code 152, as an alternative to setting the same group code for the alarm devices in a given group, a group code which is determined by a calculation between a predetermined reference code common to the alarm devices which form a group and a unique transmission source code specific to each alarm device may be set, and thereby different group code may be used for each alarm device.

The event code 154 is a code that represents the content of the event, such as an abnormal condition like a fire or a gas leak, or a failure. In the present embodiment a 3 bit code is used; for example, "001" is a fire, "010" is a gas leak, "011" is a failure, and "101" is a failure source confirmation, with the remaining kept in reserve.

By increasing the number of bits of the event code 154 to 4 bits or 5 bits when the number of event types increases, the event code can represent a plurality of event types.

Figure 13:
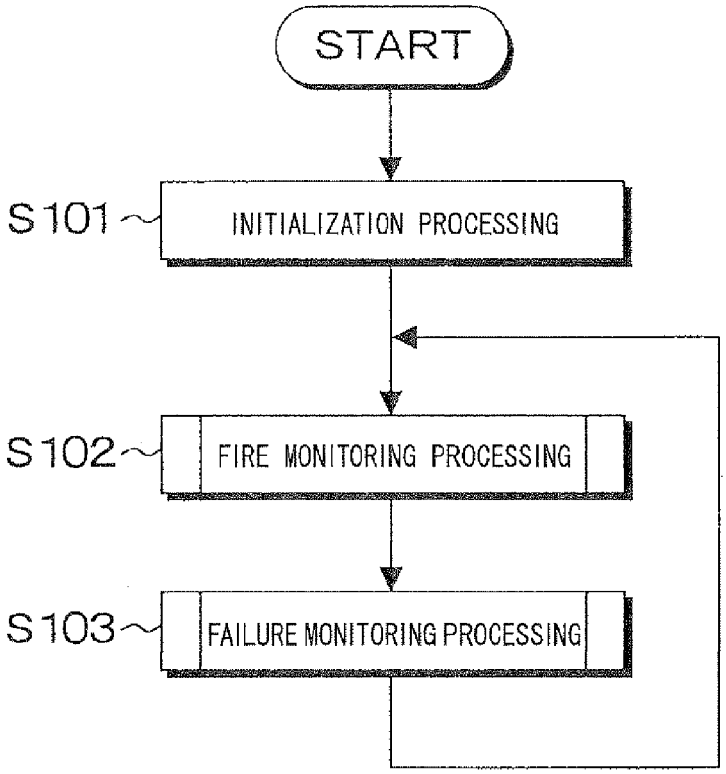
FIG. 13 is a flowchart showing the basic processing in the same embodiment.

FIG. 13 is a flowchart showing the basic processing in the present embodiment. In FIG. 13, processing in the alarm device begins with the initialization processing of step S101 when the power is switched on by enabling the power supply based on the internal battery.

This initialization processing involves processing such as grouping the five alarm devices 110-1 to 110-5 installed in the residence 124 and the garage 126 as shown in FIG. 10, and registering the same group code 152 in the memory 146 of the storage circuit section 132 of the alarm devices 110-1 to 110-5, of which the alarm device 110-1 serves as a representative example in FIG. 11. Then, on a repeated basis, fire monitoring processing is executed in step S102 which is followed by failure monitoring processing in step S103.

Figure 14:
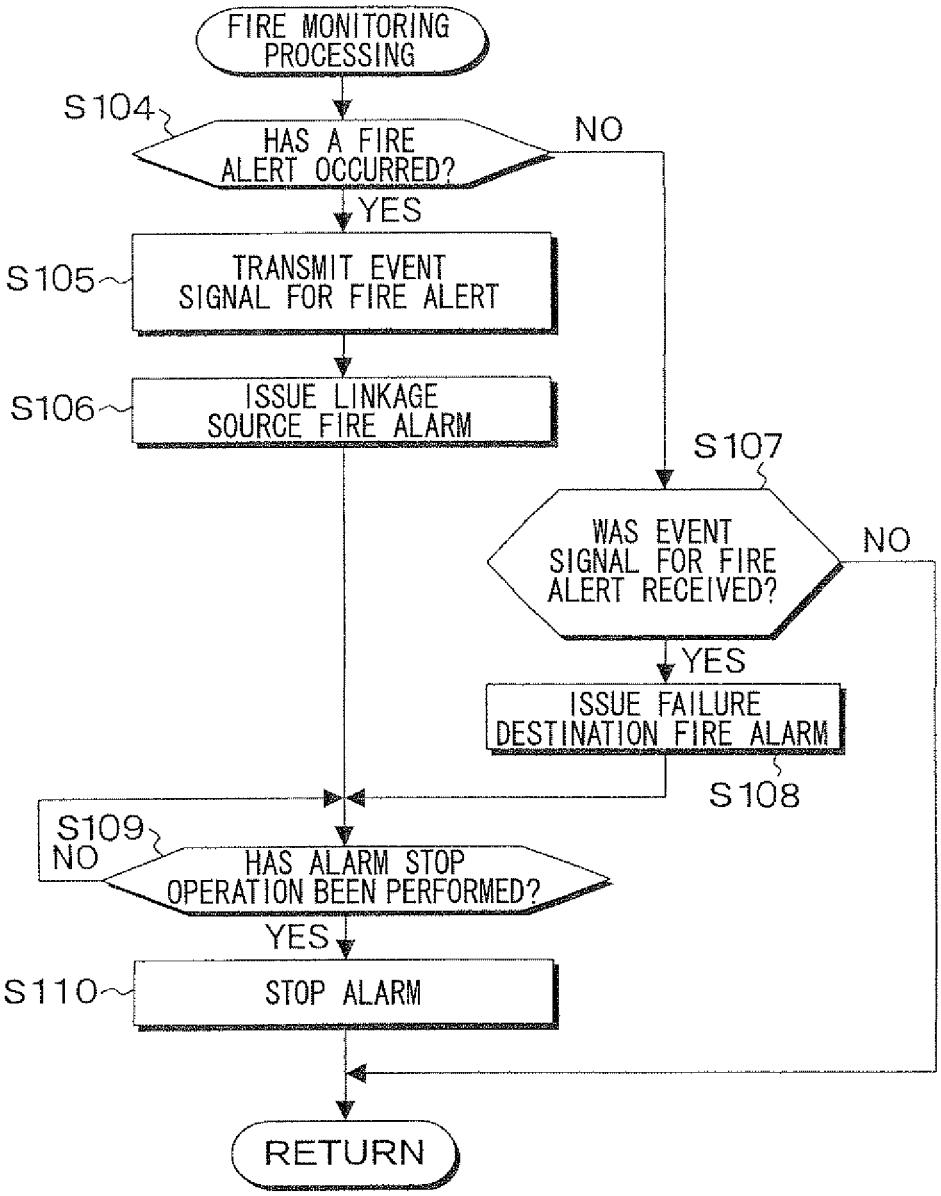
FIG. 14 is a flowchart showing in detail the fire monitoring processing in step S102 of FIG. 13.

FIG. 14 is a flowchart showing in detail the fire monitoring processing in step S102 of FIG. 13, which is described below taking as an example the alarm device 110-1 in FIG. 11.

In the fire monitoring processing of FIG. 14, in step S104 a judgment is made as to whether or not a fire alert is warranted based on the smoke detection of the smoke detector section 116 provided in the sensor section 134. If a fire alert is warranted, the flow advances to step S105, and an event signal for the fire alert is transmitted from the transmission circuit 142 of the wireless circuit section 130 to the other alarm devices 110-2 to 110-5. Then, in step S106, a siren followed by a voice message "The fire alarm has activated. Please verify.", for example, is output as a linkage source fire alarm from the speaker 156 of the alert section 136, and at the same time the LED 122 begins to flash.

Subsequently, whether or not an alarm stop operation has been performed is checked in step S109, and if operation of the alarm stop switch 120 of the operation section 138 is identified, the flow advances to step S110 and the fire alarm is stopped.

On the other hand, if a judgment is made in step S104 that no fire alert is warranted, the flow advances to step S107, and a check is performed as to whether or not an event signal indicating a fire alert has been received from any of the other alarm devices 110-2 to 110-5. If such an event signal has been received, the flow advances to step S108, and a siren followed by a voice message "A fire alarm in another room has activated. Please verify." is output continuously as a failure destination fire alarm from the speaker 156 of the alert section 136, and at the same time the LED 122 begins to blink.

In this case also, the failure destination fire alarm is stopped in step S110 if an alarm stop operation is identified in step S109.

Figure 15:
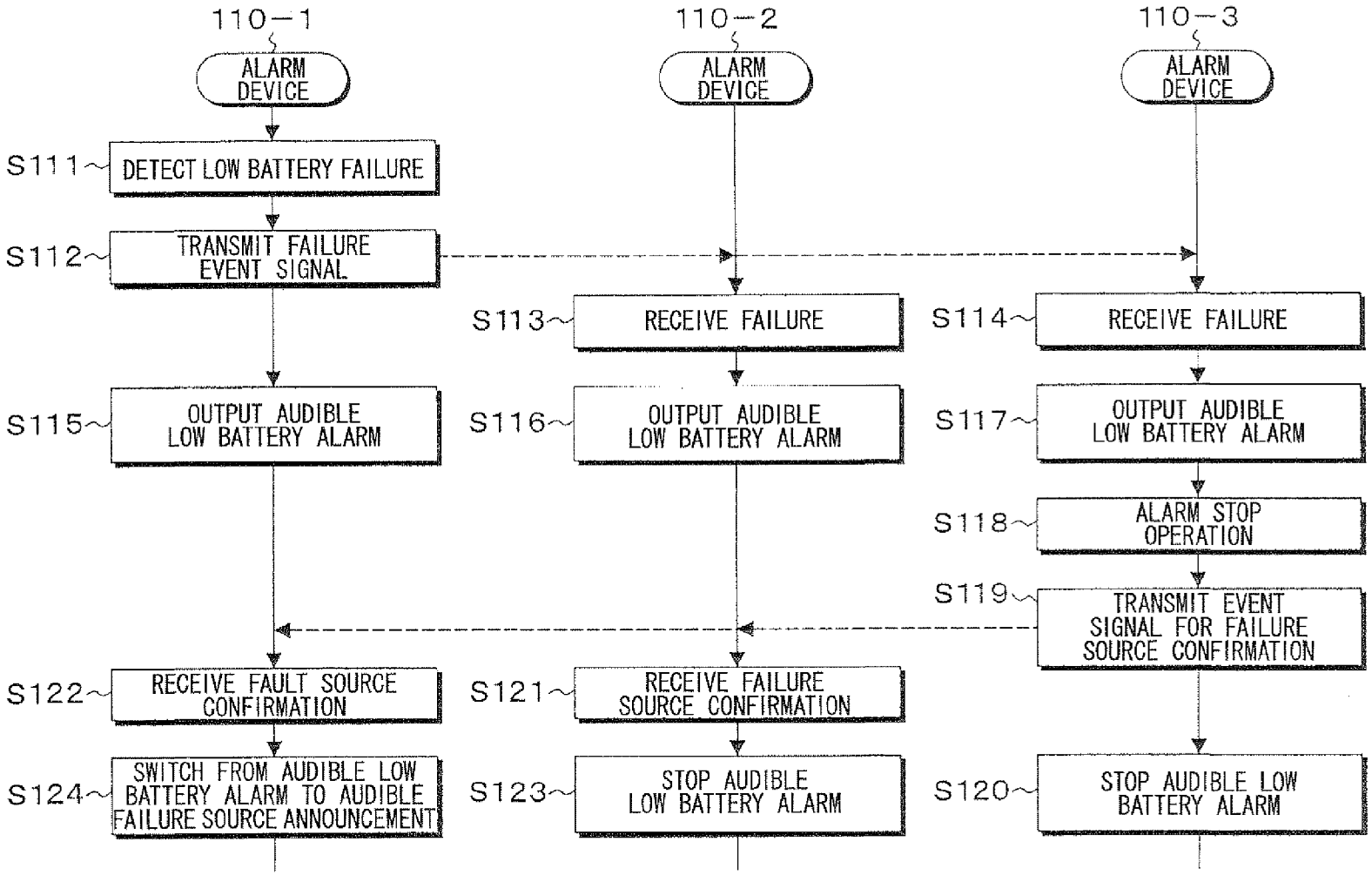
FIG. 15 is a timing chart showing the failure monitoring processing in the same embodiment.

FIG. 15 is a timing chart showing the failure monitoring processing in the present embodiment. The processing is described using the three alarm devices 110-1 to 110-3 in FIG. 11 as an example.

In FIG. 15, at this point, assuming that the alarm device 110-1 detects a low battery failure in step S111, in step S112 a failure event signal is transmitted to the other alarm devices 110-2 and 110-3. In the other alarm devices 110-2 and 110-3, the event signal is handled as a valid signal because the group code incorporated into the event signal matches, and in steps S113 and S114 respectively, the low battery failure is received and judged from the event contents.

The failure source alarm device 110-1, after transmitting a failure event signal in step S112, outputs an audible low battery alarm in step S115. The audible low battery alarm involves, for example, outputting an audible alarm such as a beep at one minute intervals, while illuminating the LED 122 in synchronization with the audible alarm. In the other alarm devices 110-2 and 110-3, upon judging that a failure is received based on the event signal received from the failure source, the audible low battery alarm is output in the same manner in step S116 and S117. As the audible low battery alarm in steps S116 and S117, an audible low battery alarm which is differentiated from the failure source audible low battery alarm, for example "A low battery was detected in another alarm device", may be used.

In this manner, in the present embodiment, when a low battery is detected in the alarm device 110-1, a low battery alert is output in all the alarm devices 110-1 to 110-3 associated with the group.

Subsequently, if a person operates the alarm stop switch 120 at the alarm device 110-3 to perform an alarm stop operation in step S118, an event signal for failure source confirmation is transmitted to the other alarm devices 110-1 and 110-2 in step S119, and the audible low battery alarm in the local alarm device is stopped in step S120.

In the alarm devices 110-1 and 110-2, the event signal for failure source confirmation is received from the alarm device 110-3, and because the group code matches, is processed as a valid event signal. From the event contents thereof, a judgment is made in steps S121 and S122 that an event signal for failure source confirmation has been received.

In the alarm device 110-2, which is not the failure source, the audible low battery alarm is stopped in step S123. On the other hand, in the alarm device 110-1, which is the failure source, in response to receiving the event signal for failure source confirmation, in step S124, the audible low battery alarm output until that point, switches to an audible announcement indicating the failure source.

This switch from the audible low battery alarm to an audible announcement of the failure source may involve, for example, from a low battery indication in the form of a short beep output at one minute intervals, switching to a louder audible alarm, outputting a voice message indicating the failure source, and further changing the intermittent illumination of the LED 122 at one minute intervals to constant or blinking illumination, thereby indicating the failure source.

Accordingly, the person who performs the operation to stop the low battery alarm of the alarm device 110-3 in step S118, upon hearing the failure source announcement output from the alarm device 110-1, can identify the alarm device 110-1 as the failure source, and take the appropriate troubleshooting measures with respect to the alarm device 110-1 which generated the low battery alarm, such as replacing the battery.

Figure 16:
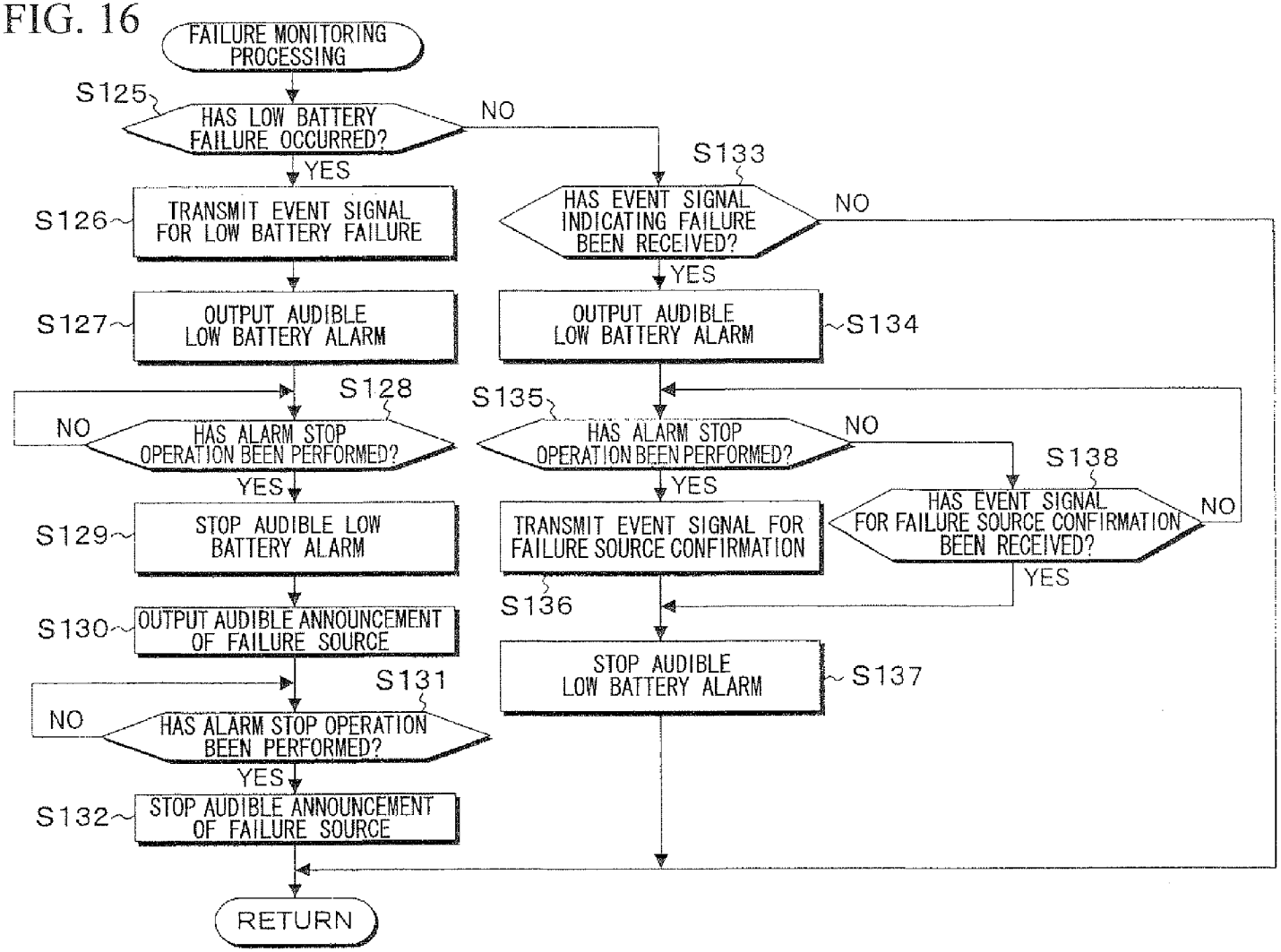
FIG. 16 is a flowchart showing in detail the failure monitoring processing in step S103 of FIG. 13.

FIG. 16 is a flowchart showing the failure monitoring processing in step S103 of FIG. 13. In the failure monitoring processing of FIG. 16, when a low battery failure is detected in step S125, an event signal for a low battery failure is transmitted to the other alarm devices in step S126.

Then in step S127, the alarm device outputs the audible low battery alarm itself, and concurrently displays the LED. If an alarm stop operation is identified in step S128, the audible low battery alarm is stopped in step S129, and because the alarm device itself is the failure source, an audible announcement of the failure source is output in step S130. If an alarm stop operation is identified in step S131, the audible failure source alarm is stopped in step S132.

On the other hand, if no low battery failure is identified in step S125, in step S133 a check is performed as to whether or not a failure event signal has been received from another alarm device. If a failure event signal has been received from another alarm device, the flow advances to step S134, an audible low battery alarm is output, and the LED is displayed. If an alarm stop operation is identified in step S135, an event signal for failure source confirmation is transmitted to the other alarm devices in step S136, after which the audible low battery alarm is stopped in step S137.

Furthermore, if no alarm stop operation is identified in step S135, in step S138 a check is performed as to whether or not an event signal for failure source conformation has been received from another alarm device. If such an event signal has been received, the audible low battery alarm is stopped in step S137.

Fourth Embodiment

Figure 17:
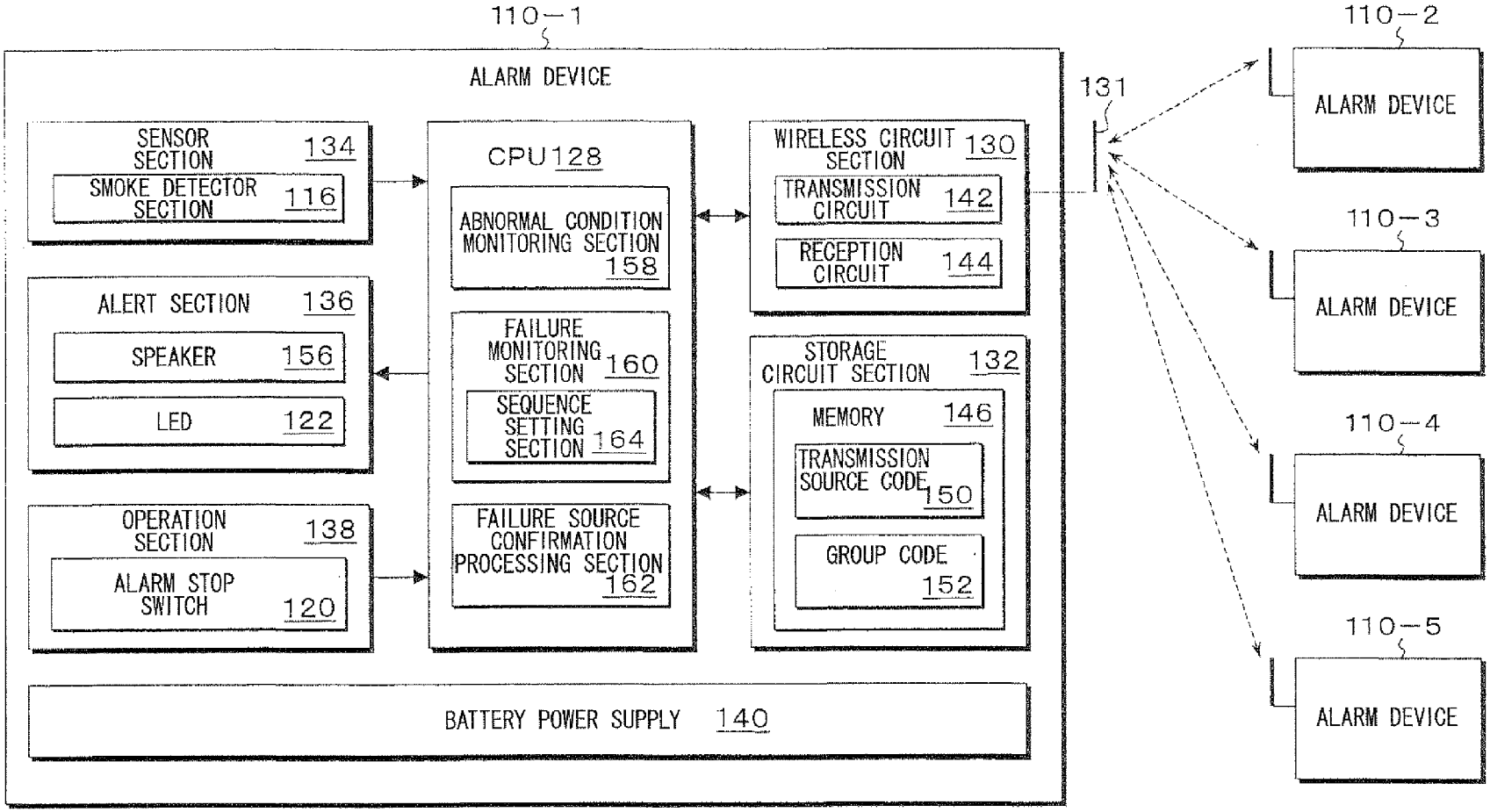
FIG. 17 is a block diagram showing an alarm device according to a fourth embodiment of the present invention.

FIG. 17 is a block diagram showing an alarm device according to a fourth embodiment of the present invention. In the present embodiment, when a failure such as a low battery is detected, a failure alarm is output by all alarm devices. However, the failure alarms are not output all together but in a predefined sequence.

As shown in FIG. 17, the alarm devices 110-1 to 110-5 comprise a circuit structure representatively illustrated by way of the alarm device 110-1. The alarm device 110-1, in the same manner as in the third embodiment shown in FIG. 11, comprises a CPU 128, a wireless circuit section 130, a storage circuit section 132, a sensor section 134, an alert section 136, an operation section 138, and a battery power supply 140. As functionality for the CPU 128, also in the same manner as in the third embodiment shown in FIG. 11, there are provided an abnormal condition monitoring section 158, a failure monitoring section 160, and a failure source confirmation processing section 162.

In the present embodiment, a sequence setting section 164 is provided in the failure monitoring section 160. The sequence setting section 164 sets a different delay time for each of the alarm devices 110-1 to 110-5, for example, so that when an event signal indicating a failure is received from one of the other alarm devices 110-2 to 110-5, each alarm device outputs a failure alarm with different timing from the others. Setting of the delay times used by the sequence setting section 164 is performed in processing subsequent to setting the group codes in the initialization processing of the alarm devices 110-1 to 110-5, and is followed by monitoring processing.

The sequence setting section 164 sets delay times using, for example, a delay time table prepared in advance which stores different delay times for the maximum number of alarm devices which constitute a single group, and based on the unique transmission source codes 150 stored in the memory 146 of each alarm device 110-1 to 110-5, for example, selects a different delay time T101 to T105.

The selection of delay times based on transmission source codes 150 may involve, for example, selecting the delay time associated with the table number that corresponds to the decimal value from 1 to 8 of the three low-order bits. Alternatively, because use of the three low-order bits may give duplicate values causing the selection of the same delay time, the table can be selected according to the decimal value from 0 to 15 of the four low-order bits. Otherwise, the selection and setting of a different delay time for each alarm device by this sequence setting section 164 can be performed by any appropriate method.

Figure 18:
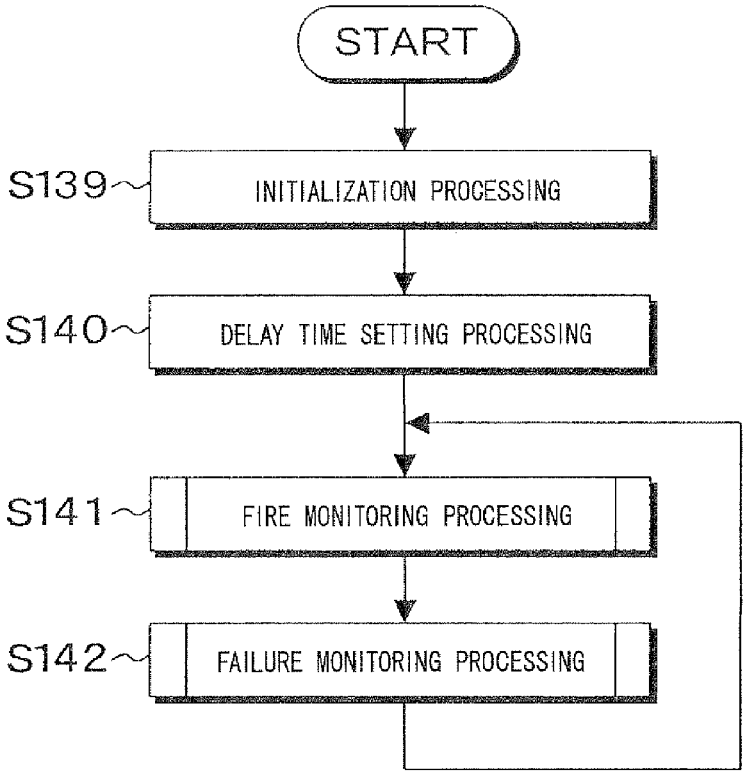
FIG. 18 is a flowchart showing the basic processing in the same embodiment.

FIG. 18 is a flowchart showing the basic processing in the present embodiment. As shown in FIG. 18, in the alarm device of the present embodiment, after the power is switched on by activating the battery power supply, initialization processing is performed in step S139, and at this stage group formation is performed based on group code settings. Then, in step S140 the delay time setting processing is executed by the sequence setting section 164.

This processing for setting delay times involves, for example, selecting from a predefined table of delay times the entry corresponding to the value of a plurality of low-order bits of the transmission source code 150. Then, on a repeated basis, fire monitoring processing is performed in step S141, followed by failure monitoring processing in step S142.

Figure 19:
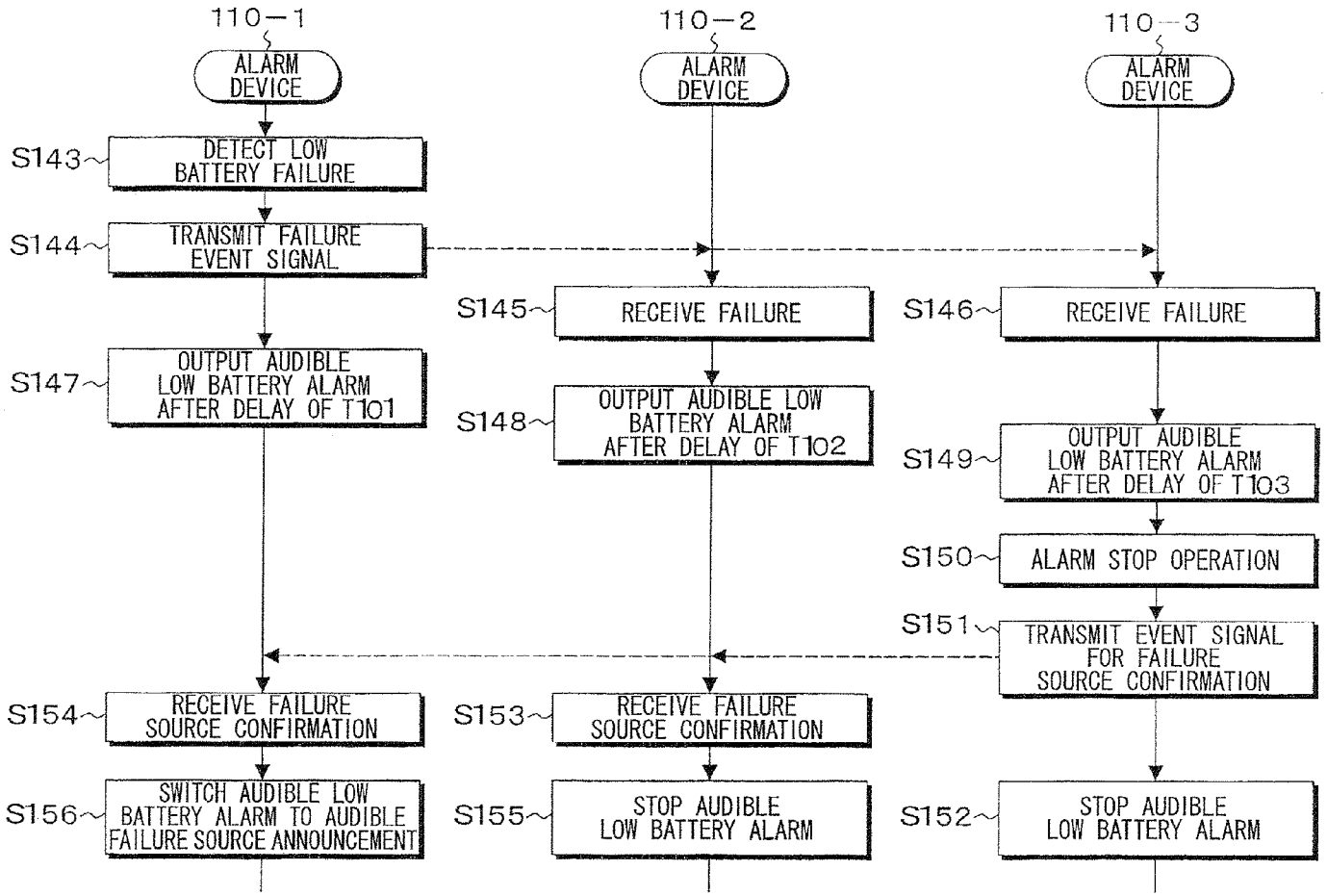
FIG. 19 is a timing chart showing the failure monitoring processing in the same embodiment.

FIG. 19 is a timing chart showing the failure monitoring processing in the present embodiment, using the example of three alarm devices 110-1 to 110-3.

As shown in FIG. 19, when the alarm device 110-1 detects a low battery failure in step S143, a failure event signal is transmitted to the other alarm devices 110-2 and 110-3 in step 3144, and is received in steps S145 and S146 respectively.

Then, in step S147 the failure source alarm device 110-1 outputs an audible low battery alarm after a lapse of the time T101 set for the alarm device. Furthermore, the alarm devices 110-2 and 110-3, after the respectively assigned delay times T102 and T103, output audible low battery alarms in steps S148 and S149. Moreover, the audible low battery alarms output in steps S148 and S149 may be different from that output by the failure source, for example "A low battery was detected in another alarm device."

Here, the relationship T101<T102<T103 applies, and therefore the time at which the audible low battery alarm is output differs in the plurality of alarm devices 110-1 to 110-3, and the audible low battery alarms are output in sequence according to the respective delay times.

Because the audible low battery alarm is output intermittently on a repeated basis at one minute intervals, for example, the alarm devices 110-1, 110-2, and 110-3, after outputting the audible low battery alarm in sequence according to their respective timings in steps S147, S148, and S149, each output a further low battery alarm after a lapse of one minute, in a repeating cycle.

During this sequential output of audible low battery alarms, if in step S150 an alarm stop operation is performed in the alarm device 110-3, for example, an event signal for failure source confirmation is transmitted to the other alarm devices 110-1 and 110-2 in step S151, and the audible low battery alarm of the alarm device 110-3 is stopped in step S152.

The alarm devices 110-1 and 110-2 receive the event signal for failure source confirmation in steps S153 and S154, and because the alarm device 110-2 is not the failure source, the audible low battery alarm thereof stops in step S155. On the other hand, because the alarm device 110-1 is the failure source, in step S156 the audible low battery alarm switches to an audible failure source announcement, thereby announcing that the alarm device 110-1 is the failure source.

Figure 20:
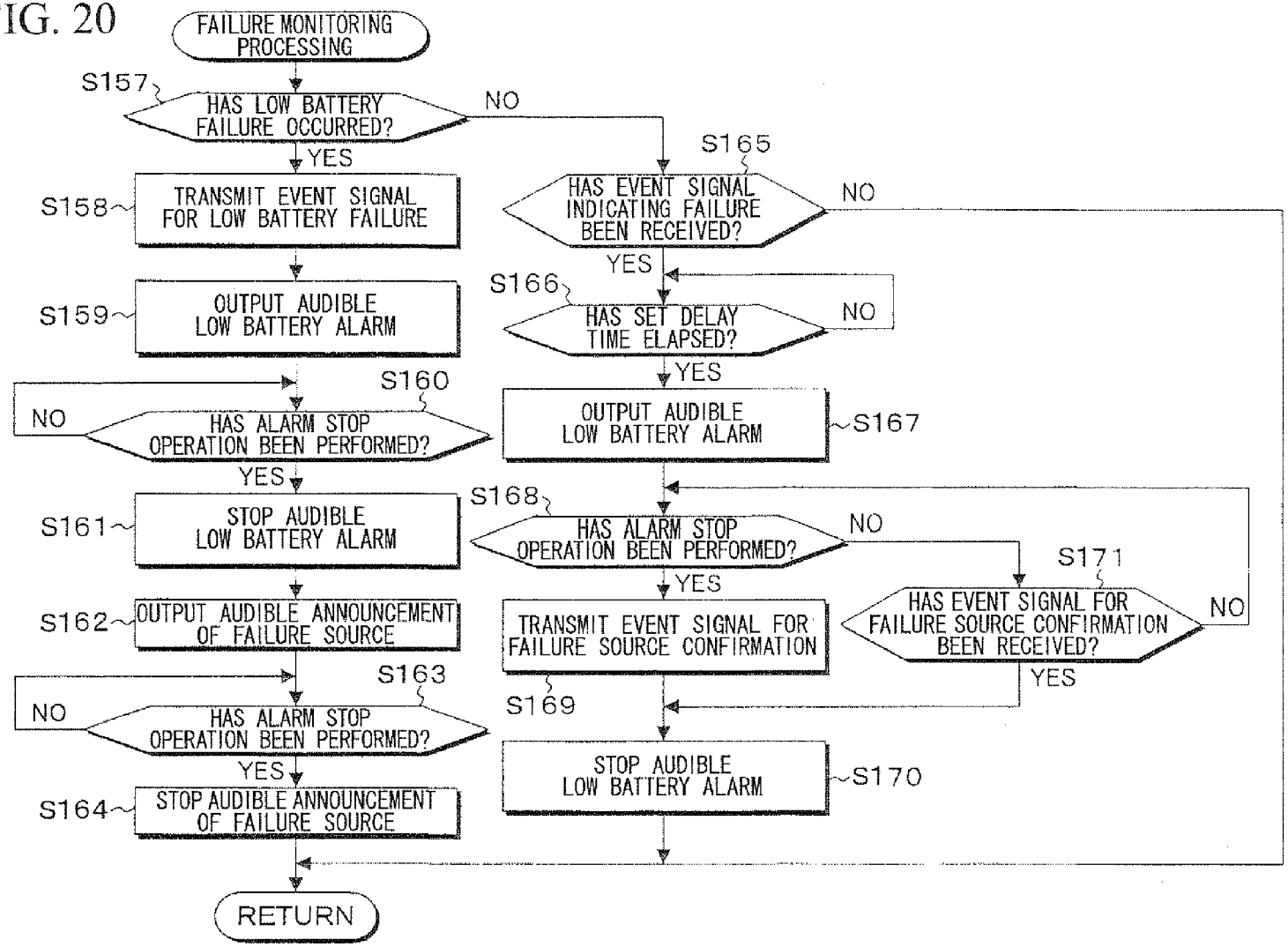
FIG. 20 is a flowchart showing in detail the failure monitoring processing in step S142 of FIG. 18.

FIG. 20 is a flowchart showing in detail the failure monitoring processing in step S142 of FIG. 18. In the failure monitoring processing of FIG. 20, if a law battery failure is judged in step S157, an event signal for the low battery failure is transmitted to the other alarm devices in step S158, and the local alarm device outputs an audible low battery alarm in step S159.

If an alarm stop operation is then judged in step S160, the audible low battery alarm is stopped in step S161, and being the failure source, the alarm device outputs an audible announcement of this fact in step S162. Then, if an alarm stop operation is judged in step S163, the audible announcement indicating the failure source is stopped in step S164.

On the other hand, if no low battery failure is identified in step S157, the flow advances to step S165, and a judgment is made as to whether or not a failure event signal has been received from one of the other alarm devices. If a failure event signal has been received, the flow advances to step S166, and when the set delay time has elapsed, an audible low battery alarm is output in step S167.

If an alarm stop operation is identified in step S168, an event signal to confirm the failure source is sent to the other alarm devices in step S169, after which the audible low battery alarm is stopped in step S170. If an alarm stop operation is not identified in step S168, in step S171 a check is performed as to whether or not an event signal for failure source confirmation has been received from another alarm device, and if such an event signal has been received, the audible low battery alarm is stopped in step S170.

In FIG. 19 and FIG. 20, an example is used in which the alarm device which is the failure source, detects the low battery failure, transmits an event signal indicating the failure, and then outputs an audible low battery alarm without waiting for a preset delay time to elapse (step S147 in FIG. 19 and step S159 in FIG. 20). However the failure source alarm device may also output the audible low battery alarm after a preset delay time has elapsed.

In this manner, when a failure alarm is to be output by all alarm devices, by outputting the failure alarm in a sequential manner, a situation in which a plurality of alarm devices installed in a residence, all output a failure alarm concurrently thereby creating an unacceptable amount of noise can be avoided, and by performing an alarm stop operation on the nearest alarm device during this sequential output of failure alarms, the failure source alarm device can be quickly identified by relying on the audible announcement output by the failure source alarm device, allowing the appropriate corrective measures to be taken.

Fifth Embodiment

Figure 21:
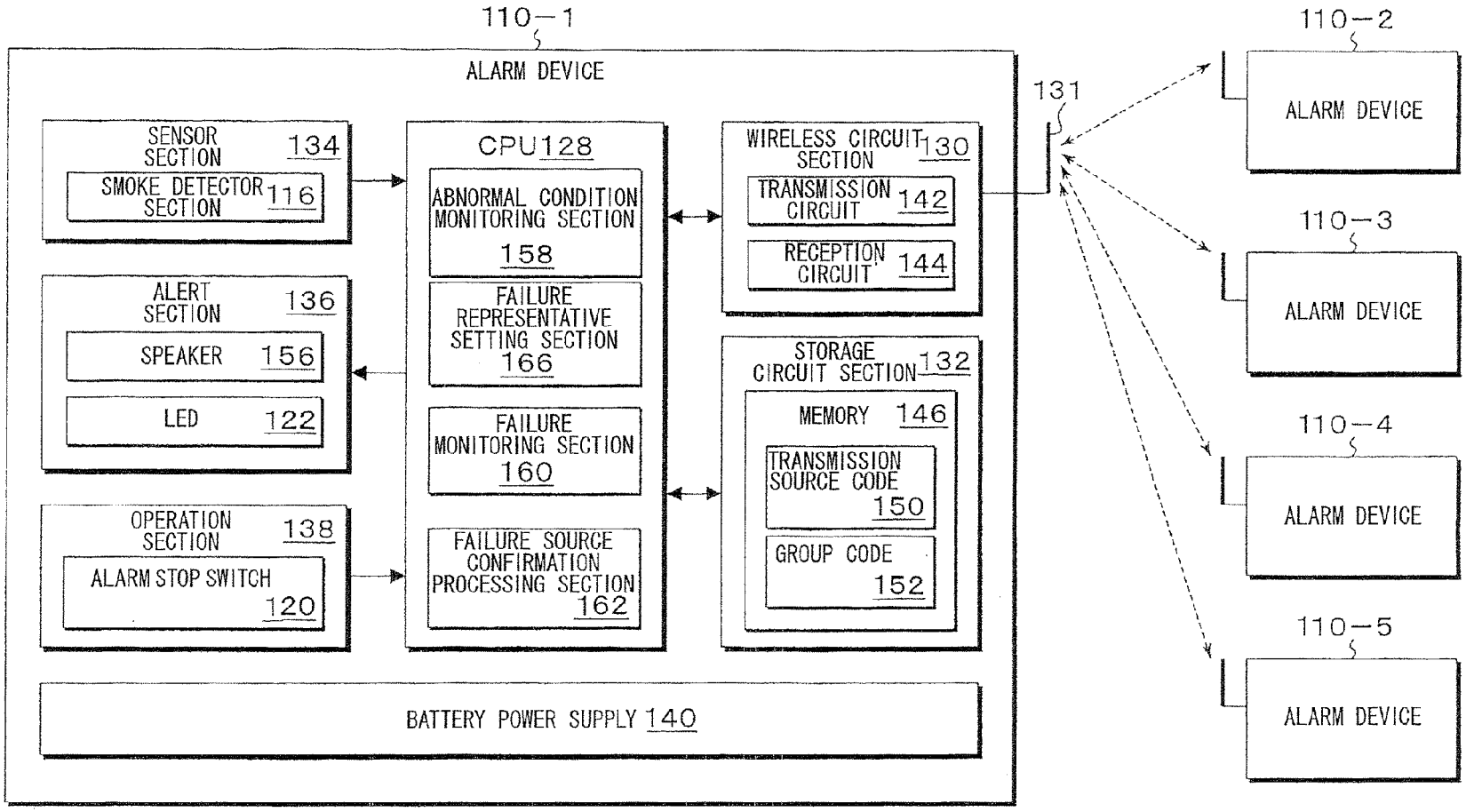
FIG. 21 is a block diagram showing an alarm device according to a fifth embodiment of the present invention.

FIG. 21 is a block diagram showing an alarm device according to a fifth embodiment of the present invention. In the present embodiment, failure alarms are output by a predetermined representative alarm device and by the failure source alarm device.

As shown in FIG. 21, the construction of the alarm device 110-1 which represents the detailed construction of the alarm devices 110-1 to 110-5 is fundamentally the same as the construction of the third embodiment, and comprises a CPU 128, a wireless circuit section 130, a storage circuit section 132, a sensor section 134, an alert section 136, an operation section 138, and a battery power supply 140. As functionality for the CPU 128, in the same manner as the embodiment shown in FIG. 11, there are provided an abnormal condition monitoring section 158 and a failure source confirmation processing section 162, and also provided as functionality inherent to the fifth embodiment are a failure representative setting section 166 and a failure monitoring section 160.

In the initial setup stage which includes grouping the alarm devices 110-1 to 110-5, the failure representative setting section 166 sets in advance whether to nominate a representative for failure announcements. As the method of setting a failure representative, the failure representative setting section 166 may adopt one of the methods given below.

(1) In the context of a residence, the representative alarm device can be set to an arbitrary alarm device such as that installed in the living room which is occupied for the most time.

(2) The representative alarm device can be set automatically based on the unique transmission source code 150 of the alarm device, for example, when the alarm devices are installed in a residence and power is turned on.

(3) The alarm device that last stopped emitting sound can be set as the failure representative.

(4) The alarm device subjected to an alarm stop operation the greatest number of times can be set as the failure representative.

(5) Other

In this manner, after the failure representative setting section 166 has set whether or not to nominate a failure representative, when the failure monitoring section 160 detects a failure, if a representative setting is in effect, an audible failure alarm is output, and if a representative setting is not in effect, an event signal indicating the failure is transmitted to the other alarm devices.

Moreover the failure monitoring section 160, upon receiving an event signal indicating a failure from one of the other alarm devices 110-2 to 110-5, outputs an audible failure alarm as the representative if the representative setting is in effect, but does not output an audible failure alarm if the representative setting is not in effect.

Figure 22:
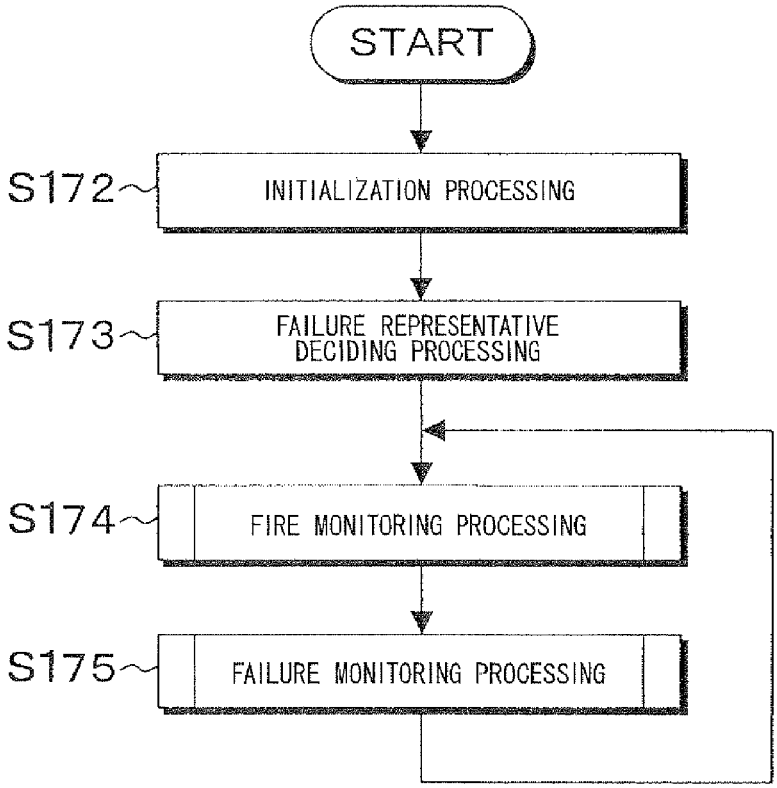
FIG. 22 is a flowchart showing the basic processing in the same embodiment.

FIG. 22 is a flowchart showing the basic processing of the present embodiment. As shown in FIG. 22, in the alarm device of the present embodiment, after the initialization processing including group formation is performed when the power supply is switched on in step S172, processing to decide the failure representative is performed by way of processing by the failure representative setting section 166 in step S173. Then, on a repeated basis, fire monitoring processing is executed in step S174 followed by failure monitoring processing in step S175.

Figure 23:
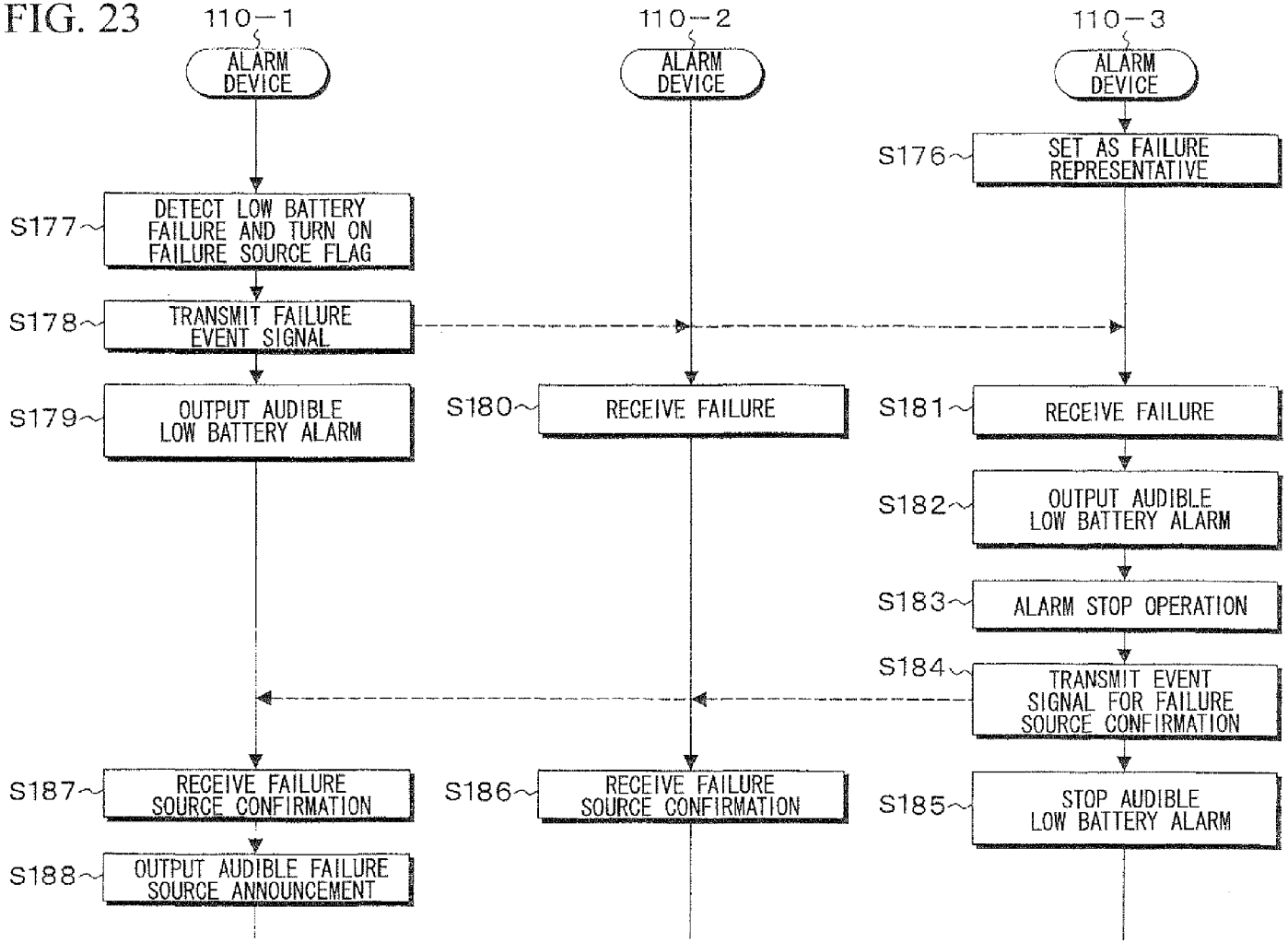
FIG. 23 is a timing chart showing the failure monitoring processing in the same embodiment.

FIG. 23 is a timing chart showing the failure monitoring processing of the present embodiment. In FIG. 23, an assumption is made that the alarm device 110-3 is set as the failure representative as shown by step S176. In this state, if the alarm device 110-1 detects a low battery failure in step S177, the failure source flag is switched on, an event signal indicating the failure is transmitted to the alarm devices 110-2 and 110-3 in step S178, and then in step S179 an audible low battery alarm of the failure source is output.

The alarm devices 110-2 and 110-3 whose group codes match, receive the event signal indicating the failure in steps S180 and S181 respectively. Here, in the alarm device 110-3, because the failure representative setting was implemented in step S176, an audible low battery alarm is output in step S182. Moreover, the audible low battery alarm of step S182 may be differentiated from that of the failure source alarm, for example "A low battery was detected in another alarm device."

In contrast, in the alarm device 110-2, because the failure representative setting is not implemented, no low battery related output is performed. Accordingly, of the plurality of alarm devices 110-1 to 110-3, only the alarm device 110-3 designated the representative, and the failure source alarm device 110-1 output an audible low battery alarm.

Then in the alarm device 110-3, if an alarm stop operation is performed in step S183, an event signal for failure source confirmation is transmitted to the other alarm devices 110-1 and 110-2 in step S184, after which the audible low battery alarm is stopped in step S185.

The event signal for failure source conformation is received by the alarm devices 110-1 and 110-2 in steps S185 and S186. In this case, because the alarm device 110-1 is the failure source, an audible announcement indicating the failure source is output in step S188.

Figure 24:
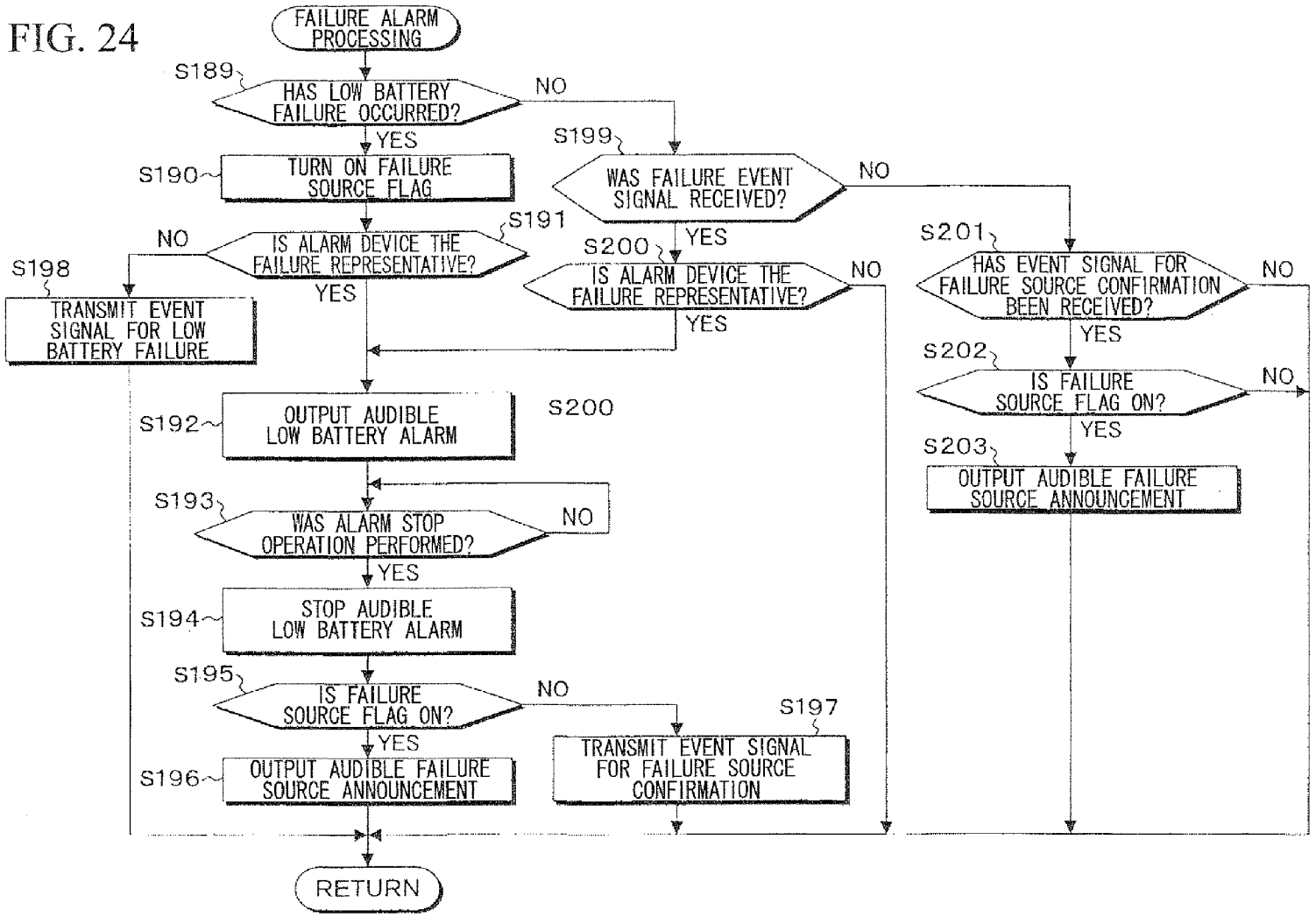
FIG. 24 is a flowchart showing in detail the failure monitoring processing in step S175 of FIG. 22.

FIG. 24 is a flowchart showing in detail the failure monitoring processing in step S175 of FIG. 22. In the failure monitoring processing of FIG. 24, if a low battery failure is judged in step S189, the failure source flag is switched on in step S190, and then in step S191 a check is made as to whether or not the alarm device is the failure representative.

If the alarm device is deter mined to be the failure representative, an audible low battery alarm is output in step S192, and if an alarm stop operation is identified in step S193, the audible low battery alarm is stopped in step S194, after which a check is performed in step S195 as to whether or not the failure source flag is on.

If the failure source flag is on, because this indicates that the alarm device itself is the failure source, output switches from an audible low battery alarm to an audible failure source announcement in step S196. If the failure source flag is off, because this indicates that another alarm device is the failure source, an event signal for confirming the failure source is transmitted to the other alarm devices in step S197.

On the other hand, if in step S191 the alarm device is not the failure representative, an event signal indicating the low battery failure is transmitted to the other alarm devices in step S198, and as this is the failure source an audible low battery alarm is output.

If a low battery failure is not judged in step S189, then a check is performed in step S199 as to whether or not an event signal indicating a failure has been received from another alarm device. If such an event signal has been received, the flow advances to step S200, whether or not the alarm device is the failure representative is determined, and if the alarm device is the failure representative, the processing in steps S192 to S197 is performed in the same manner as if the alarm device were the failure source. If the alarm device is judged not to be the failure source in step S200, the processing to output an audible low battery alarm is not performed, and the flow returns to the main routine in FIG. 22.

If on the other hand an event signal indicating a failure has not been received from another alarm device in step S199, the flow advances to step S201, and a check is performed as to whether or not an event signal for failure source confirmation has been received. If such an event signal is received, whether or not the failure source flag is on is checked in step S202, and if the flag is on, indicating that the alarm device is itself the failure source, an audible announcement of the failure source is output in step S203.

The alarm device shown in the present embodiment is a smoke based fire alarm which detects fires by measuring the smoke produced during a fire, but may be a heat based type which measures heat or a type which measures the infrared or ultraviolet rays produced by flames.

Furthermore, in the present embodiment, an example of a low battery alarm is used as the failure alarm of the alarm device, but the present embodiment can be applied in the same manner to failures such as sensor failures or any other relevant failure.

Moreover, in the embodiments above, an example of an alarm device intended to detect fires as an abnormal condition is used, but the present embodiment can be applied without modification to alarm devices that detect other abnormal conditions, such as gas leak alarms and burglar alarms. Moreover, the present embodiment is applicable not just to residential use, but also to alarm devices with a range of applications in buildings and offices.

Furthermore, the embodiments described above use an example where the sensor section and alarm output processing section are integrated with the alarm device, but as another embodiment an alarm device in which the sensor section and alarm output processing section are provided as separate units from the alarm device can also be used.

Moreover, in the embodiments above, an example of a failure alarm in a wireless alarm device is used, but the present embodiments are similarly applicable to failure alarms in wired alarm devices.

Furthermore, in the present invention, appropriate variations that retain the objectives and advantages thereof are included within its scope. Moreover, the invention is not limited on the basis of the numerical values indicated in the embodiments.

According to the present invention, an alarm device capable of performing reliable linked alarm output wirelessly between a plurality of alarm devices can be provided.

What is claimed is:

1. An alarm device comprising:

a wireless circuit section which wirelessly exchanges event signals with an other alarm device;

an alert section which outputs an alarm;

an operation section which accepts a predetermined operation;

a sensor section which issues an abnormal condition detection signal when an abnormal condition occurred is detected within a monitoring area;

an abnormal condition monitoring section which, upon receiving the abnormal condition detection signal from the sensor section, outputs an abnormal condition alarm as a linkage source from the alert section, and transmits an event signal indicating the abnormal condition to the other alarm device, and conversely, upon receiving an event signal indicating an abnormal condition from the other alarm device, outputs an abnormal condition alarm as a linkage destination from the alert section;

a communication test transmission processing section which, at a predetermined timing, transmits an event signal indicating a communication test to the other alarm device and;

a communication test reception processing section which, upon receiving an event signal indicating a communication test from the other alarm device, announces the reception status of the event signal.

2. An alarm device according to claim 1, wherein the communication test transmission processing section transmits an event signal indicating the transmission test to the other alarm device either when the operation section is operated, when a predetermined time has elapsed since the operation section was operated, or when an event signal indicating the transmission test is received from the other alarm device.

3. An alarm device according to claim 1, wherein the communication test reception processing section, upon receiving an event signal indicating the communication test from the other alarm device, measures the signal strength, and if the measured signal strength exceeds a predetermined threshold strength, judges a normal test, and issues an announcement.

4. An alarm device according to claim 3, wherein the threshold strength is a value obtained by adding a predetermined value to the reception sensitivity of the wireless circuit section.

5. An alarm device according to claim 3, wherein the communication test reception processing section, upon judging a normal test, issues an announcement corresponding to the measured signal strength.

6. An alarm device according to claim 1, wherein the communication test transmission processing section, when no communication test has been performed for longer than a fixed period, issues an announcement urging that a communication test be performed.

7. An alarm device according to claim 1, wherein when the communication test reception processing section judges an abnormal test, at least a behavior and processing performed in the role of a linkage destination is stopped, permitting operation as a dedicated linkage source alarm device or a standalone alarm device.

8. An alarm device comprising:

a transmission and reception section which exchanges event signals with an other alarm device;

a sensor section which detects an abnormal condition and issues an abnormal condition detection signal;

an alert section which outputs an abnormal condition alarm;

an operation section having an alarm stopping device;

an abnormal condition monitoring section, provided integrally or separately, which upon receiving the abnormal condition detection signal from the sensor section, outputs the abnormal condition alarm as a linkage source from the alert section and transmits an event signal indicating an abnormal condition to the other alarm device, and conversely, upon receiving an event signal indicating an abnormal condition from the other alarm device, outputs an abnormal condition alarm as a linkage destination from the alert section and;

a failure monitoring section which, when a failure is detected in the sensor section, outputs a failure alarm and transmits an event signal indicating the failure to the other alarm device, and conversely, upon receiving an event signal indicating a failure from the other alarm device, outputs a failure alarm in a linked manner.

9. An alarm device according to claim 8 further comprising a failure source confirmation processing section which, if operation of the alarm stop device is detected during linked output of the failure alarm, transmits an event signal for failure source confirmation to the other alarm device, and conversely, when an event signal for failure source confirmation is received from the other alarm device when the alarm device itself is the failure source, outputs an abnormal condition alarm indicating the failure source.

10. An alarm device according to claim 8, wherein the failure monitoring section, upon receiving an event signal indicating a failure from the other alarm device, after a predetermined time has elapsed which differs from that of the other alarm device, outputs an audible failure alarm in a linked manner.

11. An alarm device comprising:

a transmission and reception circuit section which exchanges event signals with an other alarm device;

a sensor section which detects an abnormal condition;

an alert section which outputs an abnormal condition alarm;

an operation section having an alarm stop device;

an abnormal condition monitoring section which, upon detecting an abnormal condition in the sensor section, outputs the abnormal condition alarm as a linkage source from the alert section and transmits an event signal indicating an abnormal condition to the other alarm device, and conversely, upon receiving an event signal indicating an abnormal condition from the other alarm device, outputs the abnormal condition alarm as a linkage destination from the alert section and;

a failure monitoring section in which a representative setting for failure announcement is present or absent, which upon detecting a failure, outputs a failure alarm if the representative setting is present, and transmits an event signal indicating the failure to the other alarm device if the representative setting is absent, and conversely, upon receiving an event signal indicating a failure from the other alarm device, outputs a representative failure alarm if the representative setting is present.

12. An alarm device according to claim 11, wherein the abnormal condition monitoring section, upon detecting a failure, outputs the failure alarm even if the representative setting is absent.

13. An alarm device according to claim 11, further comprising a failure source confirmation processing section which, if operation of the alarm stop device is detected while the failure alarm is being output based on an event signal indicating a failure received from the other alarm device, switches to outputting an alarm indicating a failure source if the local alarm device is the failure source, and if the local alarm device is not the failure source, stops the failure alarm and transmits an event signal for failure source confirmation to the other alarm device, and conversely, upon receiving an event signal for failure source confirmation from the other alarm device, outputs an alarm indicating a failure source if the local alarm device is the failure source.

* * * * *